US005957608A

United States Patent [19]

Matsumoto et al.

[11] Patent Number: 5,957,608

[45] Date of Patent: Sep. 28, 1999

[54] CAP FOR WRITING INSTRUMENT

[75] Inventors: Kazuaki Matsumoto; Hiroyuki Mutou, both of Yokohama, Japan

[73] Assignee: Mitsubishi Pencil Kabushiki Kaisha, Tokyo, Japan

[21] Appl. No.: 09/004,805

[22] Filed: Jan. 9, 1998

[30] Foreign Application Priority Data

| | | | |
|---|---|---|---|
| Jan. 24, 1997 | [JP] | Japan | 9-024552 |
| Jan. 24, 1997 | [JP] | Japan | 9-024553 |
| Feb. 4, 1997 | [JP] | Japan | 9-034257 |
| May 14, 1997 | [JP] | Japan | 9-139402 |

[51] Int. Cl.[6] ..... B43K 5/00

[52] U.S. Cl. ..... 401/202; 401/213; 401/243; 401/247; 401/245

[58] Field of Search ..... 401/202, 213, 401/243, 247, 245

[56] References Cited

U.S. PATENT DOCUMENTS

| | | | |
|---|---|---|---|
| 4,380,403 | 4/1983 | Endres et al. | 401/213 |
| 5,154,526 | 10/1992 | Bothe | 401/202 |
| 5,462,379 | 10/1995 | Matsumoto et al. | 401/213 |
| 5,762,435 | 6/1998 | Fukushima | 401/213 |

FOREIGN PATENT DOCUMENTS

| | | | |
|---|---|---|---|
| 61-11016 | 4/1986 | Japan | 401/202 |
| 62-5978 | 1/1987 | Japan | 401/202 |
| 2-5991 | 2/1990 | Japan | 401/202 |
| 2-5994 | 2/1990 | Japan | 401/202 |
| 6-17581 | 5/1994 | Japan . | |
| 6613097 | 3/1967 | Netherlands | 401/245 |

*Primary Examiner*—Henry J. Recla
*Assistant Examiner*—Khoa D. Huynh
*Attorney, Agent, or Firm*—Darby & Darby

[57] ABSTRACT

Basic configuration of a cap is as follows. When the end face of an elastic seal cylinder arranged in a cap for a writing instrument is caused to abut against and come into tight contact with the end portion of the mouth piece of a barrel cylinder to hermetically seal a point assembly and the opening portion of an air groove, first, the distal end of the point assembly is hermetically sealed with the bottom of the seal cylinder. The inner opening edge portion of the seal cylinder fits on the conical portion of an ink reservoir or of a point assembly support from an intermediate portion of the conical portion, and is gradually attached to the barrel cylinder while widening the opening portion of the seal cylinder in the radial direction. When the end face of the seal cylinder abuts against and comes into tight contact with the end portion of the mouth piece and attachment of the cap is completed, the end face of the seal cylinder and the end portion of the mouth piece are in tight contact with each other throughout the entire circumference.

1 Claim, 25 Drawing Sheets

CAP FOR WRITING INSTRUMENT

BACKGROUND OF THE INVENTION (1) Field of the Invention

The present invention relates to an improvement in the cap for a writing instrument and, more particularly, to a cap for a writing instrument which has an ink tank for directly storing an ink without allowing it to be absorbed by a sliver or the like, and is provided with an ink reservoir for temporarily reserving the ink pushed out from the ink tank when air in the ink tank expands due to a temperature rise or the like, so that the ink will not drop from a point assembly or vent, a means for fixing a seal cylinder made of an elastic resin or rubber into a cap to seal the point assembly and vent of a writing instrument, and a cap for a writing instrument having an inner cap.

(2) Description of the Prior Art

In a conventional direct ink storage type writing instrument, the seal cylinder is movable in the axial direction so that the volume of its interior does not change when the cap is attached or detached, and the opening edge portion of the seal cylinder is hermetically sealed by abutting it against the conical surface of the mouth piece of barrel cylinder of the writing instrument with an appropriate pressure.

In a so-called sliver-type writing instrument, the cap is attached to the barrel cylinder to hermetically seal the point assembly and the vent. In order to ensure sealing, when the cap is attached to the barrel cylinder, the barrel cylinder and the seal portion of the cap are tightly fitted with each other immediately before this cap attaching operation is ended. While the cap is being attached, the internal space in the cap reduces. As a result, when the cap is being attached, the interior of the cap is pressurized. Inversely, when the cap is to be detached, while the tight fitting portion of the seal portion is being removed, the space in the cap increases, and accordingly its pressure is reduced. However, in the sliver-type writing element, since the interior of the cap and the rear half of the barrel cylinder where the sliver is stored are spatially continuous through a vent in the barrel cylinder, for the writing instrument the interior pressure is either increased or reduced as the entire portion. The pressure in the ink reservoir and that in the point assembly are equal, and when the cap is attached or detached, the ink will not flow out from the point assembly or vent. In the direct reservoir type writing instrument, meanwhile, a volume change in the seal cylinder is prevented during attachment and detachment of the cap due to the following reason. That is to say, assume that upon attachment or detachment of the cap, the pressure in the seal cylinder increases or reduces. If the interior of the seal cylinder is pressurized, air in the seal cylinder is compressed. Air corresponding to the compressed air flows out from the vent and enters the ink tank as bubbles through the ink reservoir. The ink overflows from the ink reservoir in an amount corresponding to the bubbles that have entered, and is reserved in the ink reservoir. Inversely, when the cap is removed from the barrel cylinder, the pressure of air in the seal cylinder is reduced, in the opposite manner to the phenomenon described above. Therefore, the ink in the ink tank is drawn out by vacuum and is reserved in the ink reservoir, or is drawn out from the point assembly by suction. In this manner, every time the cap is attached or detached, the reserved ink amount of the ink reservoir increases to finally exceed the reservoir capacity. Then, the ink flows out from the vent, or leaks from the point assembly. In order to prevent this phenomenon, the conventional direct ink reservoir type writing instrument employs the following structure.

In the cap of the conventional direct ink reservoir type writing instrument, the seal cylinder is movable in the axial direction in order to hermetically seal the comparatively hard seal cylinder, made of polypropylene or polyethylene, without increasing or reducing the pressure in the seal cylinder when the cap is attached or detached, so that the opening edge portion of the seal cylinder comes into contact with the conical surface of the mouth piece of the barrel cylinder of the writing instrument. This makes the structure being complicated and the number of components increased. This results in increase in product unit cost and the complicated assembly further lead to increase in assembly cost.

When the seal cylinder made of an elastic resin or rubber is to be fixed in the cap of the conventional writing instrument, the seal cylinder is pressed into and fitted with an inner cylinder arranged in the cap or with a plurality of ribs the diameter of the inscribed circle of which is slightly smaller than the outer diameter of the seal cylinder.

Furthermore, with a means for fixing the seal cylinder made of the elastic resin or rubber into the cap of the conventional writing instrument, when the cap is mounted on the writing instrument main body, the opening inner edge and flange portion of the seal cylinder come into tight contact with a portion around the vent in the front portion of the barrel cylinder, to close the vent. Nevertheless, since the seal cylinder is made of the elastic resin or rubber, an adhesion force acts also on the barrel cylinder due to the self-tackiness. Accordingly, when the cap is detached, the seal cylinder adheres to the barrel cylinder to come off from the cap.

According to another prior art, a writing instrument is known which has an ink tank in its barrel cylinder and an ink reservoir. The ink tank directly stores the ink. When the ink in the tank is pushed out excessively due to expansion caused by a temperature rise or the like, the ink reservoir temporarily absorbs the excessive ink so it will not be flown out from the point assembly and the like. As a cap that can be attached on and detached from such a writing element, one having an inner cap that can seal the point assembly and an air exchange hole formed in a writing element barrel cylinder near the point assembly is known. However, the above-described cap structure also has the following drawbacks.

When a cap having such an inner cap is employed, after the point assembly of the writing instrument is inserted in the inner cap, the writing instrument barrel cylinder must be engaged with the cap main body, so that the inner cap reliably seals the point assembly of the writing instrument. Hence, after the point assembly of the writing instrument is inserted in the inner cap and is sealed, it is further pushed into the inner cap. Air in the inner cap is compressed and pressurized. The compressed air enters the ink tank in the writing instrument barrel cylinder through the air exchange hole to excessively push out the ink in the ink tank. The pushed ink is reserved in the ink reservoir. When the cap is to be removed from the writing instrument barrel cylinder, the internal pressure of the inner cap is reduced inversely. Accordingly, the ink is excessively drawn out by suction from the ink tank and is similarly reserved in the ink reservoir. Every time the cap is attached and detached, the ink in the ink reservoir increases. When the ink reservoir becomes full of the ink, the overflowing ink leaks from the air exchange hole.

In order to solve these problems, the present applicant previously developed a cap as disclosed in Japanese Utility Model Publication Hei 6 No.17581. An inner cap is mounted in this cap to be movable in the axial direction while being supported with a coil spring. When the inner cap is pushed by the writing instrument barrel cylinder, it moves while compressing the coil spring, so air in the inner cap will not be compressed by the writing instrument barrel cylinder.

However, use of the coil spring increases the number of components and the number of assembly steps, leading to an increase in cost.

SUMMARY OF THE INVENTION

It is an object of the present invention to provide a cap that solves the problems described above.

Also, it is another object of the present invention to provide a cap for a writing instrument in which the point assembly of the writing instrument and an air exchange hole formed in the writing instrument barrel cylinder near the point assembly can be sealed with an inner cap, the pressure of air in the inner cap can be prevented from being increased or reduced during attachment or detachment of the cap, and the number of components to be assembled in the inner cap is decreased, thereby decreasing the cost.

The present invention has been made in order to solve the problems described above, and its gists are as follows.

The first gist of the present invention resides in, in a direct ink reservoir type water-based ball point pen having a tank in a rear portion of a barrel cylinder to directly store an ink and an ink reservoir in a front portion of the barrel cylinder, a cap for a writing instrument wherein, when attaching the cap to a barrel cylinder, a distal end portion of a point assembly of the ball point pen abuts against and comes into tight contact with a cup-like bottom mounted in the cap and made of an elastic resin or rubber to hermetically seal an ink outflow portion of the point assembly, an inner opening edge of a seal cylinder is fitted on a conical surface of a front portion of the ink reservoir or on a conical surface of a point assembly support from an intermediate portion of the conical surface, and upon completion of attachment of the cap, an end portion of a mouth piece is pushed to abut with a pressure against and comes into tight contact with an end face of the seal cylinder to hermetically seal an opening portion of an air groove and a point assembly.

The second gist of the present invention resides in, in a direct ink storage type writing instrument having a tank in a rear portion of a barrel cylinder to directly store an ink and an ink reservoir in a front portion of the barrel cylinder, a cap for a writing instrument wherein, when attaching the cap to a barrel cylinder, an inner opening edge of a cup-like seal cylinder mounted in the cap and made of an elastic resin or rubber is fitted on an opening portion of an air groove of a conical surface of a front portion of the ink reservoir from an intermediate portion of the opening portion, and upon completion of attachment of the cap, an end portion of a mouth piece is pushed to abut with a pressure against and comes into tight contact with an end face of the seal cylinder to hermetically seal the air groove and a point assembly.

The third gist of the present invention resides in a cap for a writing instrument for storing an ink in a rear portion of a barrel cylinder and having a point assembly at a front end of a barrel cylinder, which is characterized in that a seal cylinder made of an elastic resin or rubber to hermetically seal a vent formed in a front portion of a barrel cylinder and the point assembly is inserted in an inner cylinder of the cap, a flange portion of the seal cylinder engages with an opening end portion of the inner cylinder, the flange portion having an outer diameter larger than a diameter of an inscribed circle of a plurality of engaging pieces formed in the cap, and the flange portion of the seal cylinder passes the engaging pieces while being elastically deformed, and is mounted in the cap.

The fourth gist of the present invention resides in a cap for a writing instrument, which is characterized in that an inner cap is provided in a cap main body, the inner cap having a bottomed seal cylindrical portion and a flange which is formed on an outer circumferential portion of an opening end of the seal cylindrical portion, and being entirely made of a material having flexibility and elasticity, the seal cylindrical portion serving to cover and seal a point assembly of the writing instrument and an air exchange hole formed near the point assembly, wherein the flange abuts against a cap main body, an abutting portion where the flange abuts against a writing instrument barrel cylinder is set nearer a center in a radial direction than an abutting position where the flange abuts against the cap main body, and when the abutting portion is pushed by the writing instrument barrel cylinder, the seal cylindrical portion is elastically deformed to be movable in a pushing direction of the writing instrument barrel cylinder.

The fifth gist of the present invention resides in a cap for writing instrument according to the fourth gist described above, wherein an elastic projection, which is compressed when the inner cap is pushed by the writing instrument barrel cylinder, is formed at the abutting position where the flange of the inner cap abuts against the cap main body.

The sixth gist of the present invention resides in a cap for a writing instrument according to the fourth gist described above, wherein an annular elastic projection, which is compressed when the inner cap is pushed by -the writing instrument barrel cylinder, is formed at the abutting position where the flange of the inner cap abuts against the cap main body.

The seventh to ninth gists of the present invention reside in a cap for a writing instrument according to the fourth to sixth gists described above, wherein a hooking flange portion to be hooked by the cap main body is formed to project from the outer circumferential portion of the seal cylindrical portion of the inner cap.

DETAILED DESCRIPTION OF THE PREFERRED EMBODIMENTS

The preferred embodiments of the present invention will be described in detail with reference to the accompanying drawings.

First Embodiment

Figure 1:
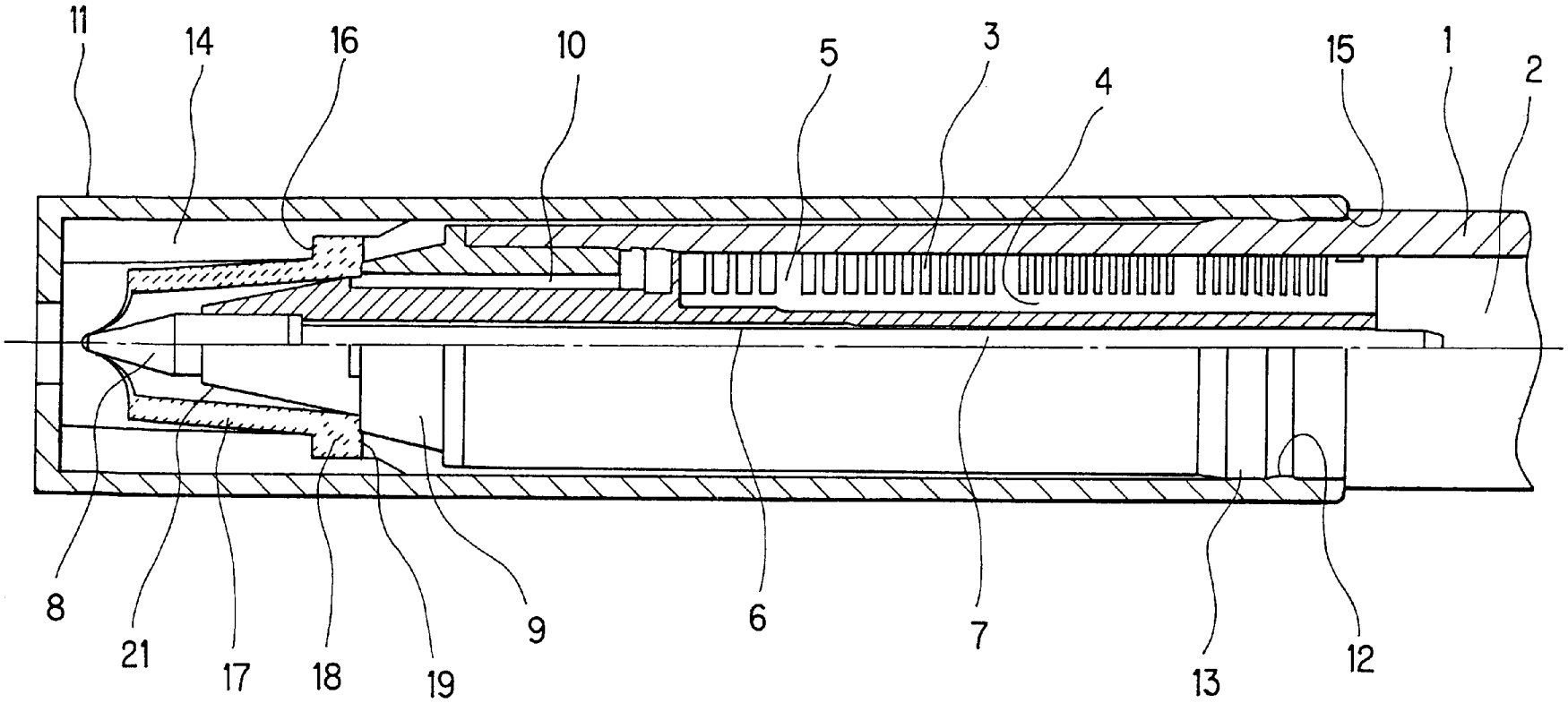
FIG. 1 is a longitudinal sectional view of a writing instrument according to the present invention.
Figure 2:
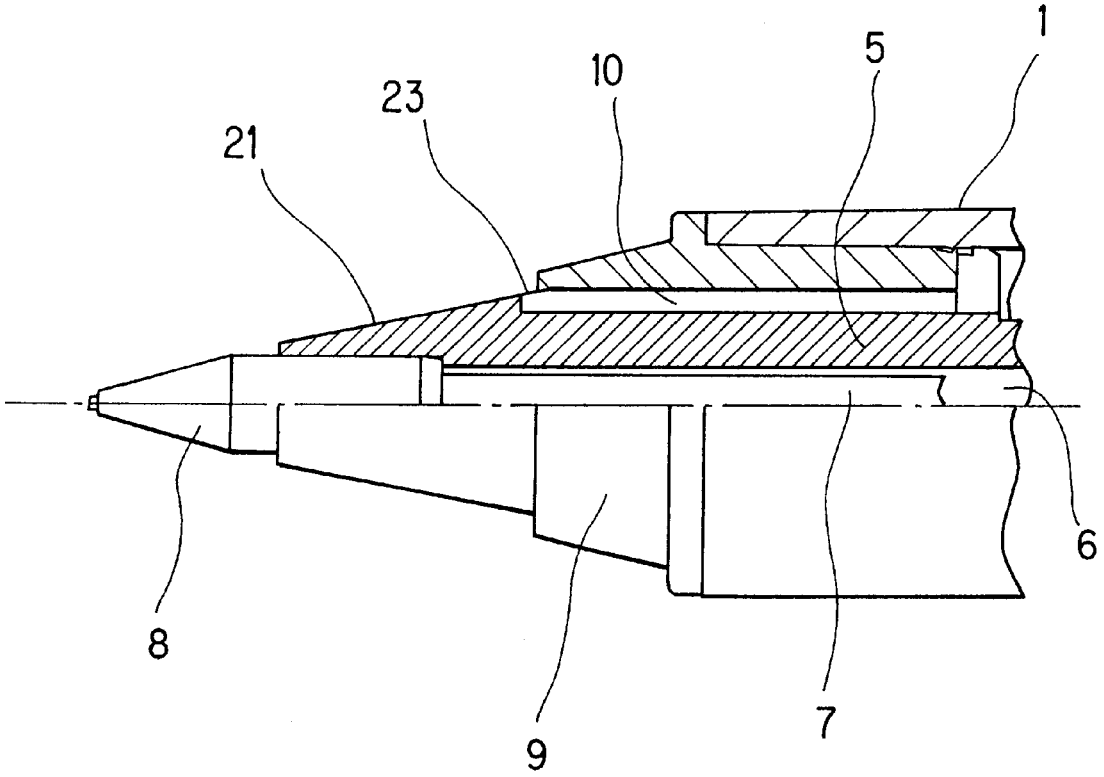
FIG. 2 is a partial sectional view of the front portion of the writing instrument main body from which the cap shown in FIG. 1 is removed.
Figure 3:
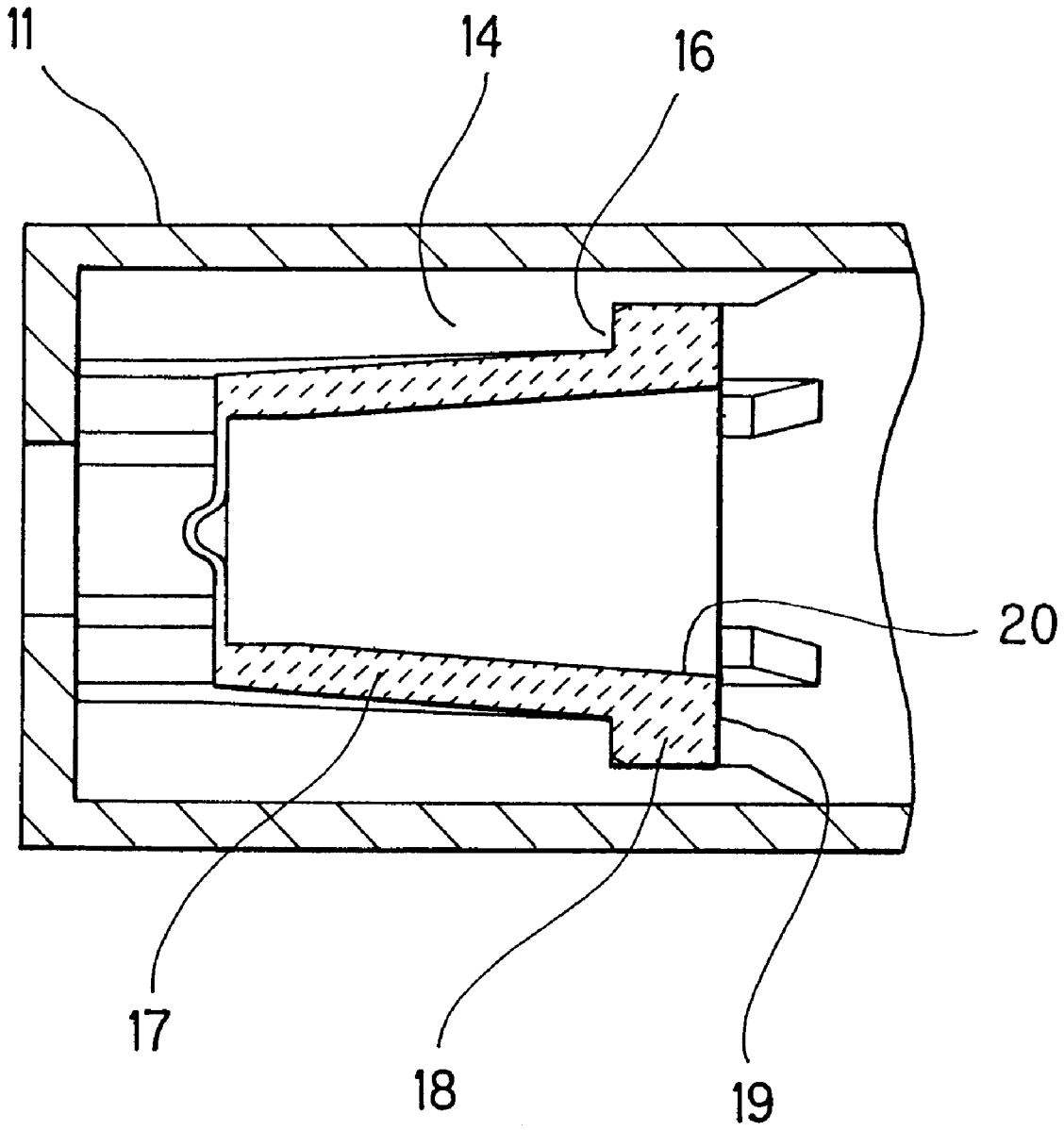
FIG. 3 is a partial sectional view of the cap from which the writing instrument main body shown in FIG. 1 is removed.

FIGS. 1 to 3 show the first embodiment of the present invention. The first embodiment will be described in detail with reference to FIGS. 1 to 3. The rear portion of a barrel cylinder 1 of the writing instrument main body forms an ink chamber 2. An ink reservoir 5, having a large number of circumferential grooves 3 in its outer circumferential surface and a longitudinal groove 4 that causes the circumferential grooves 3 to communicate with each other, is mounted on the front portion of the barrel cylinder 1. A longitudinal hole 6 extending in the axial direction is formed in the central portion of the ink reservoir 5. A feed 7 is loaded to extend through the longitudinal hole 6. The distal end of the feed 7 is connected to a point assembly 8 of the ball point pen. The ink is supplied from the ink chamber 2 to the point assembly 8 through the feed 7.

A cap 11 is formed with an engaging projection 12, which engages with a projection 13 of the barrel cylinder 1, on its inner surface near the opening edge. The engaging projection 12 engages with the projection 13 of the barrel cylinder 1. The opening end portion of the cap 11 abuts against a step portion 15 formed at the intermediate portion of the barrel cylinder 1, so that the cap 11 is attached to the barrel cylinder 1 at a predetermined position. Engaging step portions 16 are formed on ribs 14 of the cap 11. A flange portion 18 of a cup-like seal cylinder 17 made of elastic rubber or the like abuts against the engaging step portions 16 and fits with the ribs 14, so that it is engaged at a predetermined position in the cap 11. When attaching the cap 11, first, the distal end portion of the point assembly 8 is brought into tight contact with the bottom of the cup-like seal cylinder 17 made of the elastic rubber or the like to hermetically seal the ink outflow portion of the point assembly 8. An inner opening edge 20 of the seal cylinder 17 is fitted on a conical surface 21 at the front portion of the ink reservoir 5 from the intermediate portion of the conical surface 21. When attachment of the cap 11 is complete, since an end face 19 of the seal cylinder 17 abuts against an end portion 22 of a mouth piece 9 to come into tight contact with it under pressure, and the inner opening edge 20 of the seal cylinder 17 has already been in tight contact with the conical surface 21 of the ink reservoir 5, an opening portion 23 of an air groove 10 is closed.

The opening edge 20 of the seal cylinder 17 fits on the conical surface 21 of the ink reservoir 5 from the intermediate portion of the conical surface 21 and is attached to it as it widens the opening portion of the seal cylinder 17 in the radial direction. Therefore, even if the axis of the seal cylinder 17 and the axis of the barrel cylinder 1, i.e., the axis of the mouth piece 9, are misaligned from each other, the opening portion of the seal cylinder 17 is deformed when the cap is completely attached, so that the end face 19 of the seal cylinder 17 and the end portion 22 of the mouth piece 9, and the conical surface 21 of the ink reservoir 5 and the inner opening edge 20 of the seal cylinder 17 come into tight contact with each other through the entire circumference. Before the inner opening edge 20 of the seal cylinder 17 fits on the conical surface 21 of the ink reservoir 5 from the intermediate portion of the conical surface 21, the bottom of the seal cylinder 17 is brought into tight contact with the distal end of the point assembly, thereby hermetically sealing the ink outflow portion of the point assembly 8. This is due to the following reason. The opening edge 20 of the seal cylinder 17 fits on the conical surface 21 of the ink reservoir 5 from the intermediate portion of the conical surface 21, and the interior of the seal cylinder 17 is pressurized slightly until attachment of the cap 11 is complete. With this arrangement, even if the interior of the seal cylinder 17 is pressurized, air is not introduced from the ink outflow portion at the distal end of the point assembly 8 to interfere with the outflow of the ink, so that the writing operation is not hindered.

Furthermore, when the opening end portion of the cap 11 abuts against the step portion of the barrel cylinder 1 and attachment of the cap 11 is complete, the end portion 22 of the mouth piece 9 bites into the end face 19 of the seal cylinder 17 by about 0.05 mm to 0.5 mm, so that they come into tight contact with each other, thereby hermetically sealing the opening portion 23 of the air groove 10. Since the push-in amount of the end face 19 of the seal cylinder 17 into the air groove 10 is very small, an increase in atmospheric pressure in the air groove 10 is also small, and the amount of ink reserved by the ink reservoir 5 upon entrance of air into the ink chamber 2 is accordingly small. Therefore, when the ink in the ink chamber 2 is consumed by writing, the ink in the ink reservoir 5 returns to the ink chamber 2, causing no problem in practical use.

Figure 4:
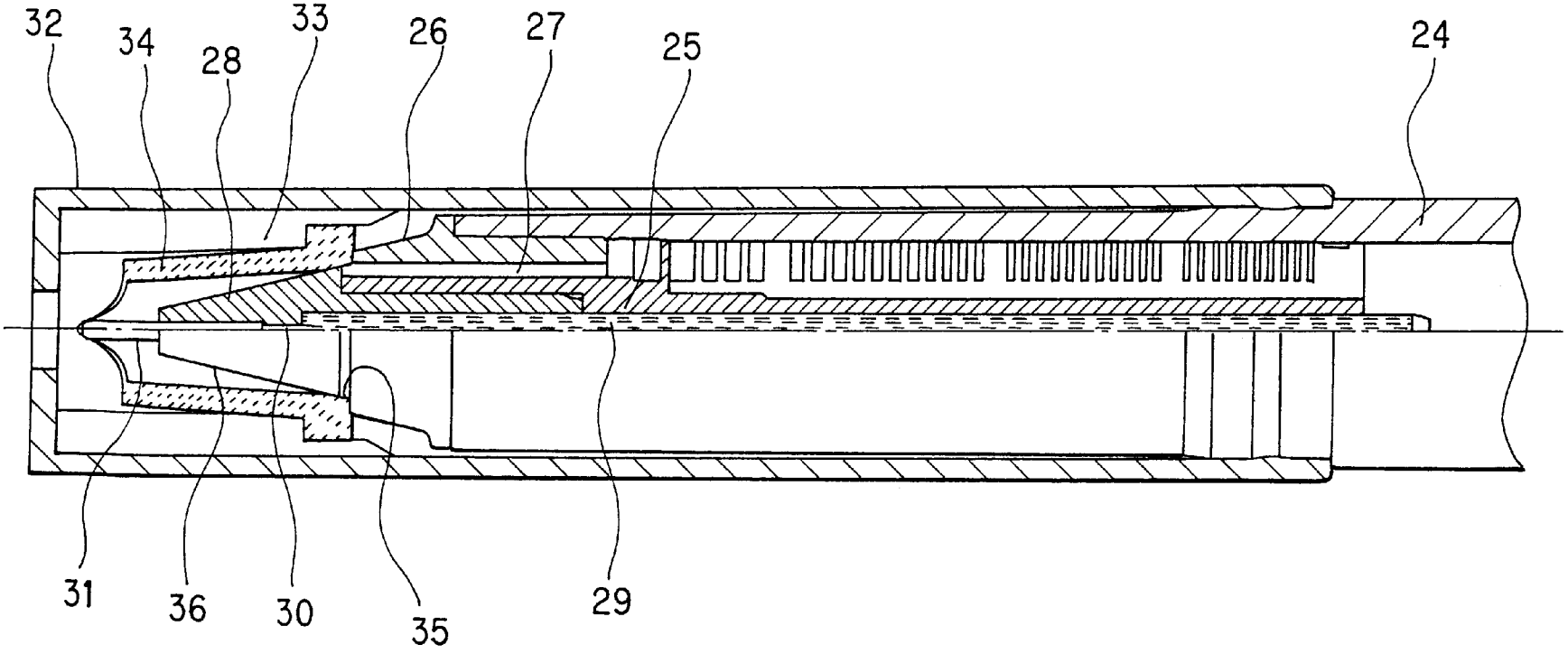
FIG. 4 shows another embodiment of the present invention.

FIG. 4 shows another embodiment in which the point assembly of a ball point pen is provided to an ink reservoir 25 through a point assembly support 28. In the case of this embodiment, an inner opening edge 35 of a seal cylinder 34 fits on a conical surface 36 of the point assembly support 28 from an intermediate portion of the conical surface 36.

Figure 5:
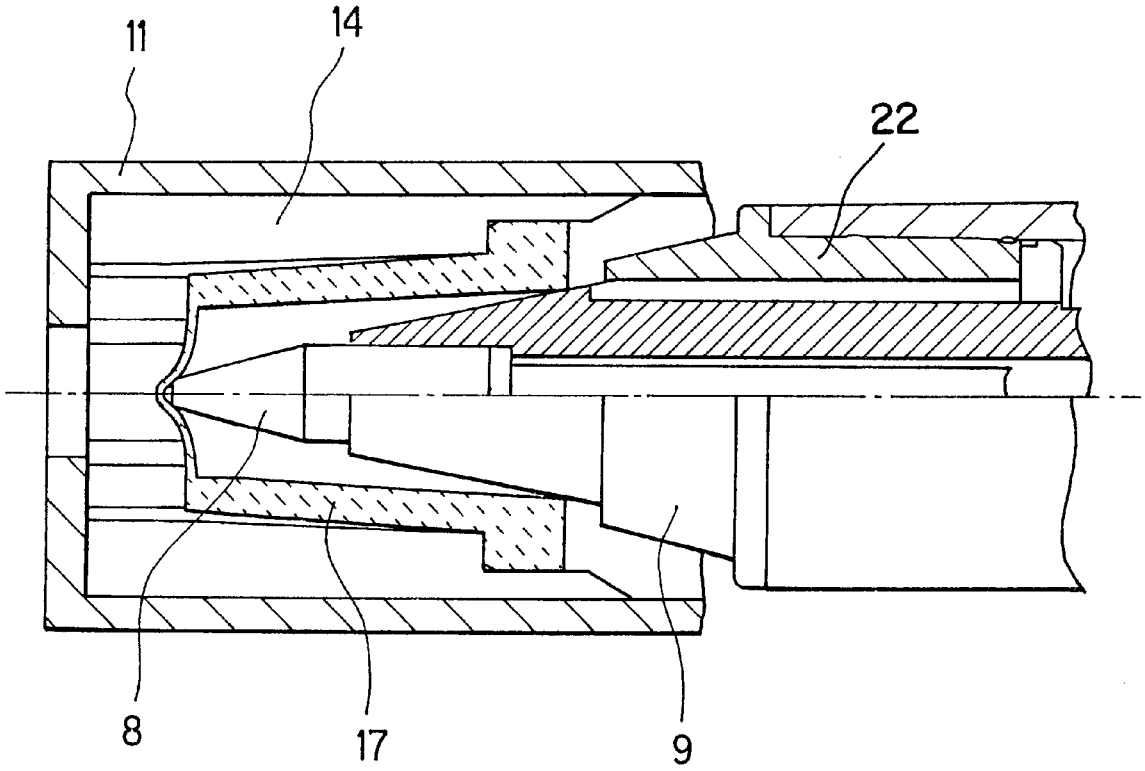
FIG. 5 is a view for a reference showing a state wherein the distal end portion of point assembly of a ball point pen is in tight contact with the bottom of a seal cylinder.
Figure 6:
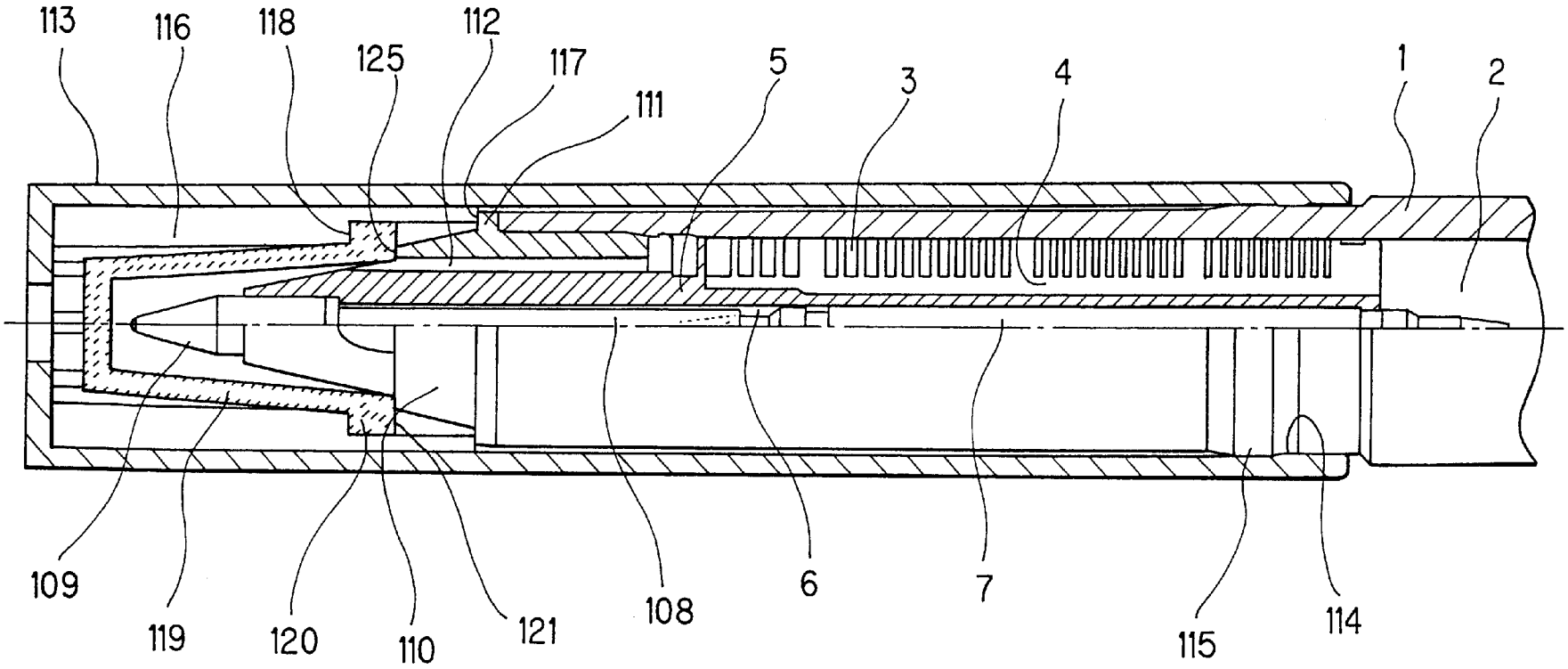
FIG. 6 is a longitudinal sectional view of a writing instrument according to the present invention.
Figure 7:
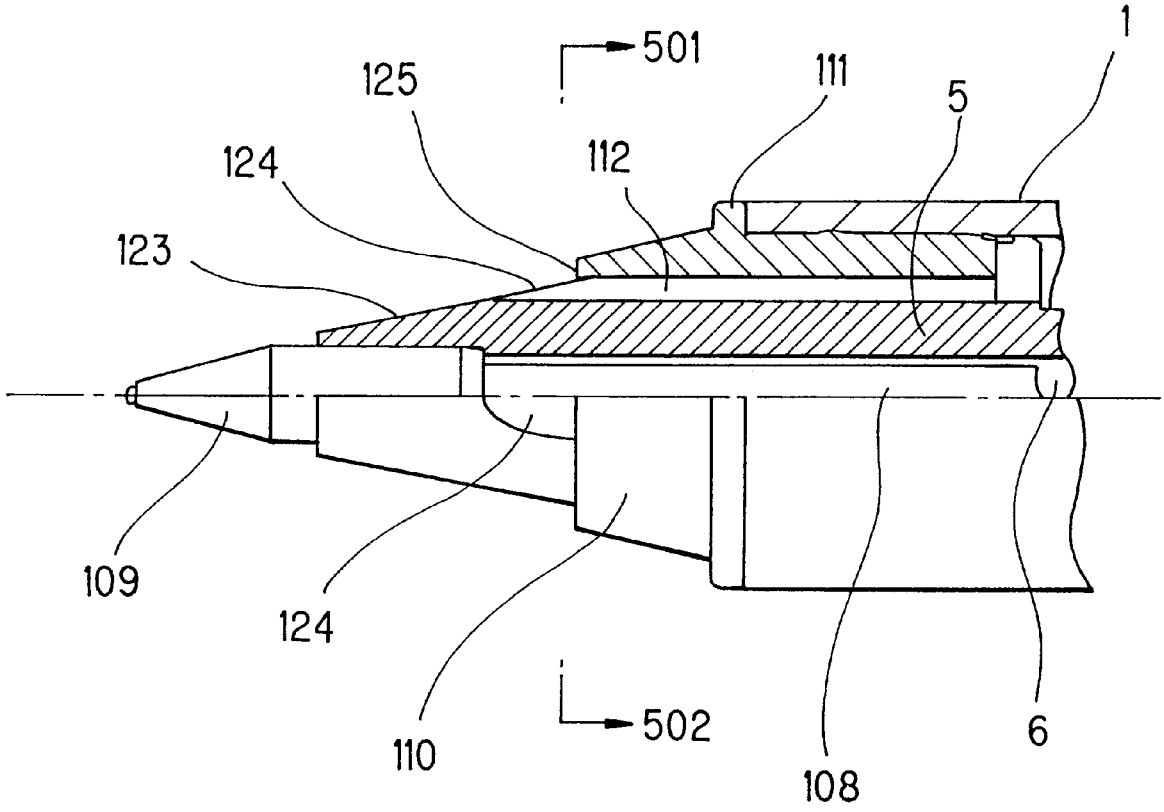
FIG. 7 is a partial sectional view of the front portion of the writing instrument main body from which the cap shown in FIG. 6 is removed.
Figure 8:
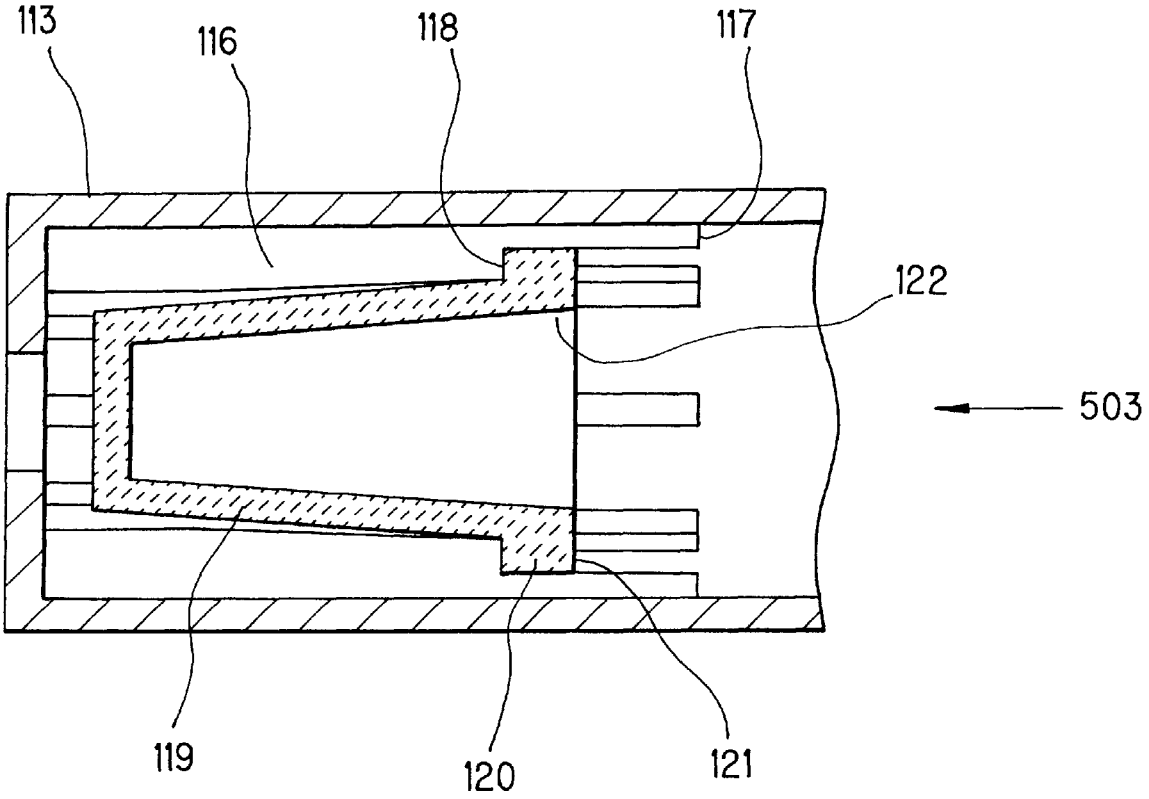
FIG. 8 is a partial sectional view of the cap from which the writing instrument main body shown in FIG. 6 is removed.
Figure 9:
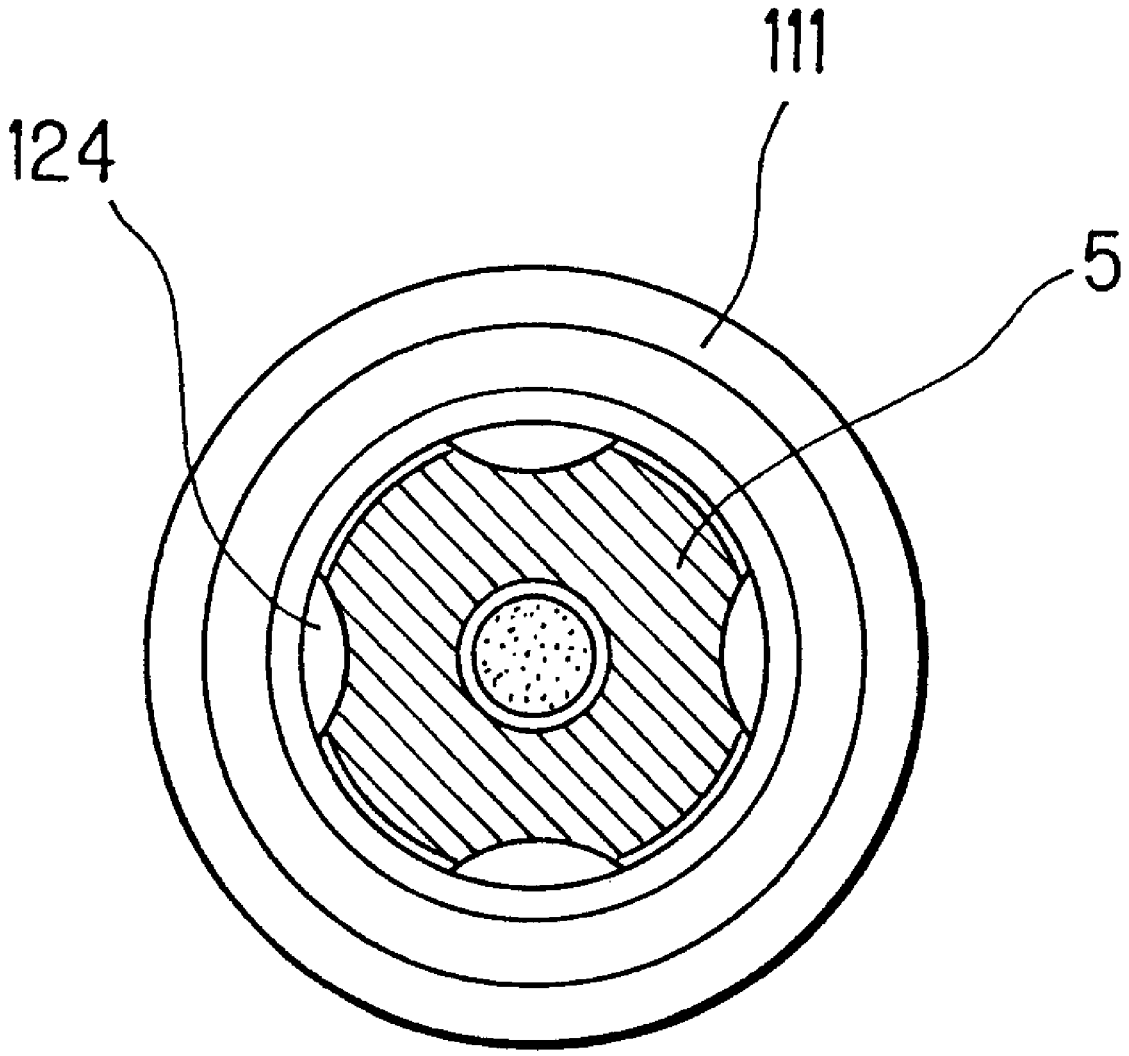
FIG. 9 is a sectional view taken along the line 501–502 of FIG. 7.
Figure 10:
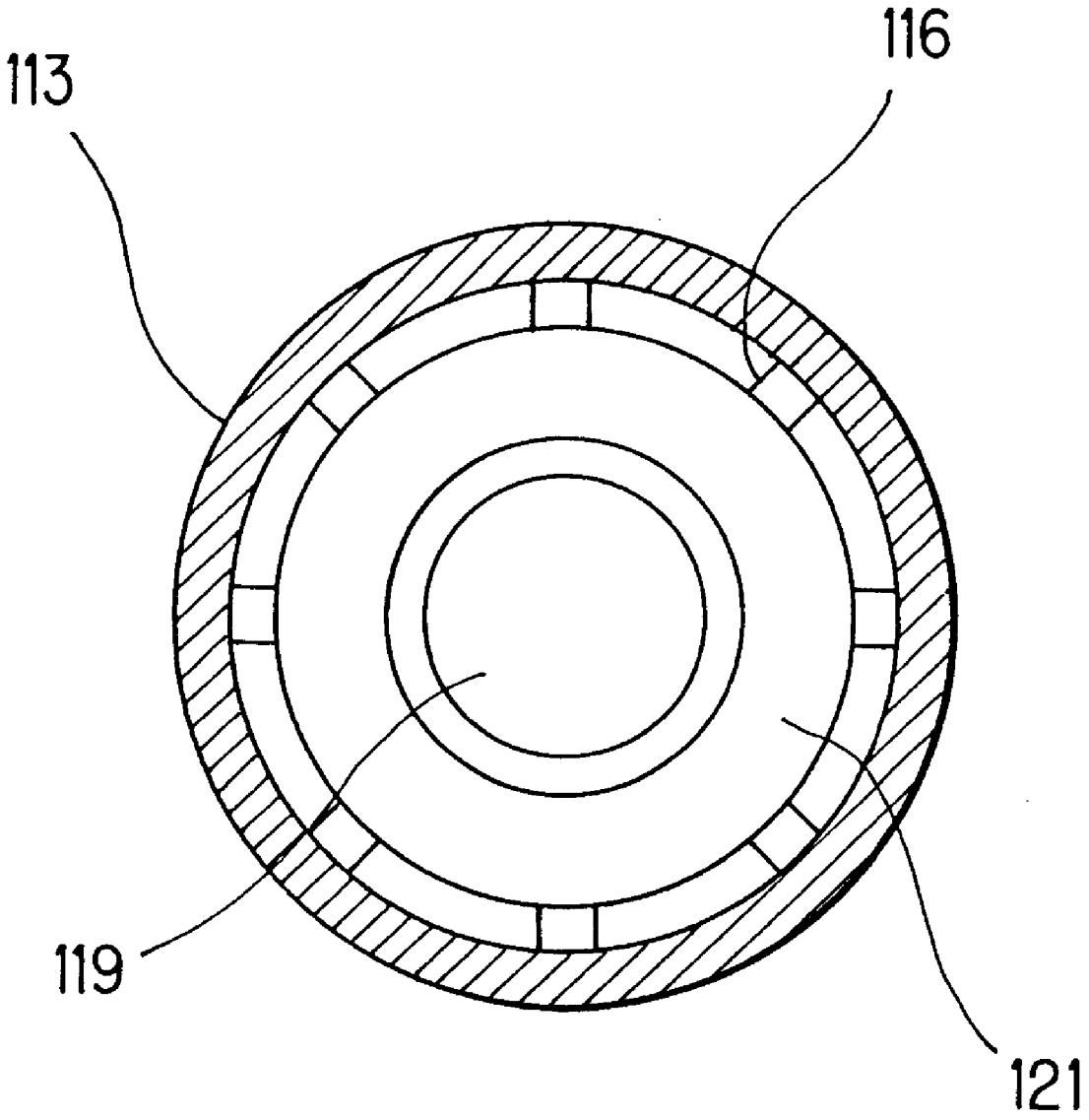
FIG. 10 is a view seen from the direction of an arrow 503 of FIG. 8.

FIG. 5 is a view for reference showing a state wherein the distal end portion of a point assembly 8 of a ball point pen is in tight contact with the bottom of a seal cylinder 17.

In the writing instrument having the above arrangement, when a cap 11 is mounted on the writing instrument main body, first, the distal end portion of a point assembly 8 is brought into tight contact with the bottom of the cup-like seal cylinder 17 made of elastic rubber or the like to hermetically seal the ink outflow portion of the point assembly 8. The inner opening edge 20 of the seal cylinder 13 is fitted on the conical surface 21 at the front portion of the ink reservoir 5 from the intermediate portion of the conical surface 21. When attachment of the cap 11 is complete, since an end face 19 of the seal cylinder 17 abuts against an end portion 22 of a mouth piece 9 to come into tight contact with it under pressure, and the inner opening edge 20 of the seal cylinder 17 has already been in tight contact with the conical surface 21 of the ink reservoir 5, an opening portion 23 of an air groove 10 is closed. Even if the interior of the seal cylinder 17 is pressurized more or less, air will not enter the point assembly 8 through its ink outflow portion. Even if the axis of the seal cylinder 17 and the axis of the mouth piece 9 are misaligned from each other, the inner opening edge 20 of the seal cylinder 17 fits on the conical surface 21 while deforming. When attachment of the cap 11 is complete, the inner opening edge 20 of the seal cylinder 17 is in tight contact with the conical surface 21 with its entire circumferential portion, and the end portion 22 of the mouth piece 9 and the end face 19 of the seal cylinder 17 are reliably in tight contact with each other throughout the entire circumference. As a result, the opening portion 23 of the air groove 10 is closed reliably.

Since the ink reservoir 5 extends to the point assembly of the writing instrument to be able to hold the writing portion, the number of components is reduced, and the air groove 10 is ensured easily.

Second Embodiment

FIGS. 6 to 10 show the second embodiment of the present invention. The second embodiment will be described in detail with reference to FIGS. 6 to 10. The rear portion of a barrel cylinder 1 of the writing instrument main body forms an ink chamber 2. An ink reservoir 5, having a large number of circumferential grooves 3 in its outer circumferential surface and a longitudinal groove 4 that causes the circumferential grooves 3 to communicate with each other, is mounted on the front portion of the barrel cylinder 1. A feed 7 is loaded to extend through a longitudinal hole 6 extending through the central portion of the ink reservoir 5 in the axial direction. The distal end of the feed 7 abuts against or pierces an inner feed 108. The inner feed 108 is connected to a point assembly 109 ahead of it, so that the ink flows from the ink chamber 2 to the inner feed 108 through the feed 7 and is supplied to the point assembly 109.

A cap 113 is formed with an engaging projection 114, which engages with a projection 115 of the barrel cylinder 1, on its inner surface near the opening edge. The engaging projection 114 engages with the projection 115 of the barrel cylinder 1. Abutting step portions 117 of a plurality of ribs 116 formed on the inner wall of the cap 113 abut against a flange portion 111 of a mouth piece 110 tightly fitted in the barrel cylinder 1, so that the cap 113 is attached to the barrel cylinder 1 at a predetermined position. Engaging step portions 118 are formed on the ribs 116 of the cap 113. A flange portion 120 of a cup-like seal cylinder 119 made of rubber abuts against the engaging step portions 118 and fits with the ribs 116, so that it is engaged at a predetermined position in the cap 113. When attaching the cap 113, an inner opening edge 122 of the seal cylinder 119 fits on an opening portion 124 of an air groove 112 of a conical surface 123 of the ink reservoir 5 from the intermediate portion of the opening portion 124 and is attached to the conical surface 123 as it widens the opening portion 124 of the seal cylinder 119 in the radial direction. Therefore, even if the axis of the seal cylinder 119 and the axis of the barrel cylinder 1, i.e., the axis of the mouth piece 110, are misaligned from each other, the opening portion of the seal cylinder 119 is deformed when the cap is completely attached, so that an end face 121 of the seal cylinder 119 and an end portion 125 of the mouth piece 110 come into tight contact with each other through the entire circumference. The inner opening edge 122 of the seal cylinder 119 fits on the opening portion 124 of the air groove 112 of the conical surface 123 of the ink reservoir 5 from the intermediate portion of the opening portion 124. With this arrangement, the interior of the seal cylinder 119 can communicate with the outer air through the opening portion 124 of the air groove 112 until the cap is completely attached. Then, the interior of the seal cylinder 119 is not pressurized, and air will not flow into the seal cylinder 119 through the distal end of the point assembly 109 to interfere with the outflow of the ink, so the writing operation is not hindered. When the flange portion 111 of the mouth piece 110 abuts against the abutting step portions 117 of the cap 113 and attachment of the cap 113 is complete, the end portion 125 of the mouth piece 110 bites into the end face 121 of the seal cylinder 119 by about 0.05 mm to 0.5 mm, so that they come into tight contact with each other, thereby hermetically sealing the air groove 112 and the point assembly 109.

In the writing instrument having the above arrangement, when the cap 113 is mounted on the writing instrument main body, the distal end portion of the writing instrument including the point assembly 109 and the air groove 112 enters the seal cylinder 119, and the end face 121 of the seal cylinder 119 abuts against the end portion 125 of the mouth piece 110. Thereafter, the barrel cylinder 1 enters the cap 113 very slightly, and the flange portion 111 of the mouth piece 110 abuts against the abutting step portions 117 of the cap 113 to be stopped by it. Simultaneously, the engaging projection 114 of the cap 113 engages with the projection 115 of the barrel cylinder 1, so that the cap 113 is maintained to be attached on the barrel cylinder 1. The end portion 125 of the mouth piece 110 slightly bites into the end face 121 of the seal cylinder 119 to come into tight contact with it, thereby hermetically sealing the air groove 112 and the point assembly 109. When the end portion 125 of the mouth piece 110 abuts against the end face 121 of the seal cylinder 119 to come into tight contact with it, the end face 121 is compressed, the internal volume of the seal cylinder 119 decreases, and the internal pressure of the seal cylinder 119 increases. Since the push-in length of the end portion 125 of the mouth piece 110 into the end face 121 of the seal cylinder 119 is very small, the interior of the seal cylinder 119 is compressed only very slightly, and the amount of ink flowing into the ink reservoir 5 is also very small. Therefore, in practice, when the ink is consumed by writing, the ink that has entered the ink reservoir 5 returns to the ink chamber 2 to fill the ink reservoir 5. Therefore, the ink will not flow out from the air groove 112. When attaching the cap 113, the inner opening edge 122 of the seal cylinder 119 fits on the opening portion 124 of the air groove 112 of the conical surface 123 of the ink reservoir 5 from the intermediate portion of the opening portion 124 and is attached to the conical surface 123 as it widens the opening portion 124 of the seal cylinder 119 in the radial direction. Therefore, even if the axis of the seal cylinder 119 and the axis of the barrel cylinder 1, i.e., the axis of the mouth piece 110, are misaligned from each other, the opening portion of the seal cylinder 119 is deformed when the cap is completely attached, so that the end face 121 of the seal cylinder 119 and the end portion 125 of the mouth piece 110 come into tight contact with each other through the entire circumference. The inner opening edge 122 of the seal cylinder 119 fits on the opening portion 124 of the air groove 112 of the conical surface 123 of the ink reservoir 5 from the intermediate portion of the opening portion 124. With this arrangement, the interior of the seal cylinder 119 can communicate with the outer air through the opening portion 124 of the air groove 112 until the cap is completely attached. Then, the interior of the seal cylinder 119 is not pressurized, and air will not flow into the seal cylinder 119 through the distal end of the point assembly 109 to interfere with the outflow of the ink, so the writing operation is not hindered.

Since the ink reservoir 5 extends to the point assembly of the writing instrument to be able to hold the writing portion, the number of components is reduced, and the air groove 112 is ensured easily.

Figure 11:
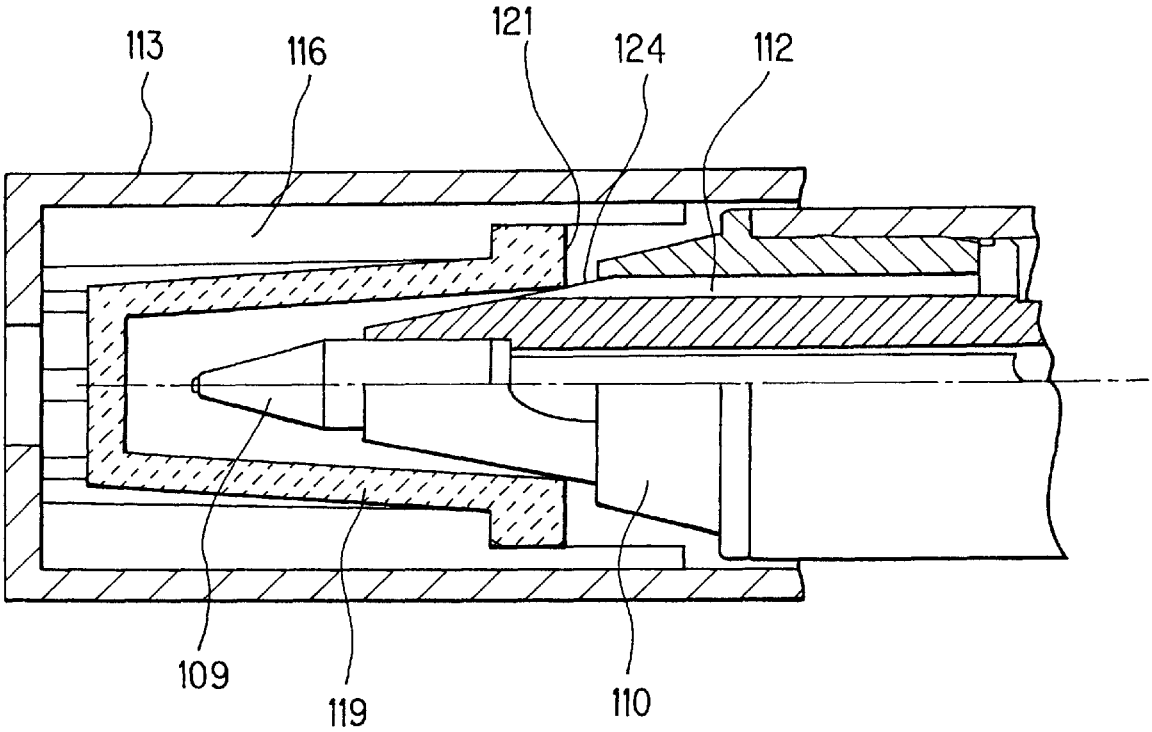
FIG. 11 is a view for a reference showing a state wherein the end face of the seal cylinder starts to fit with the opening portion of an air groove from the intermediate portion of the opening portion.
Figure 12:
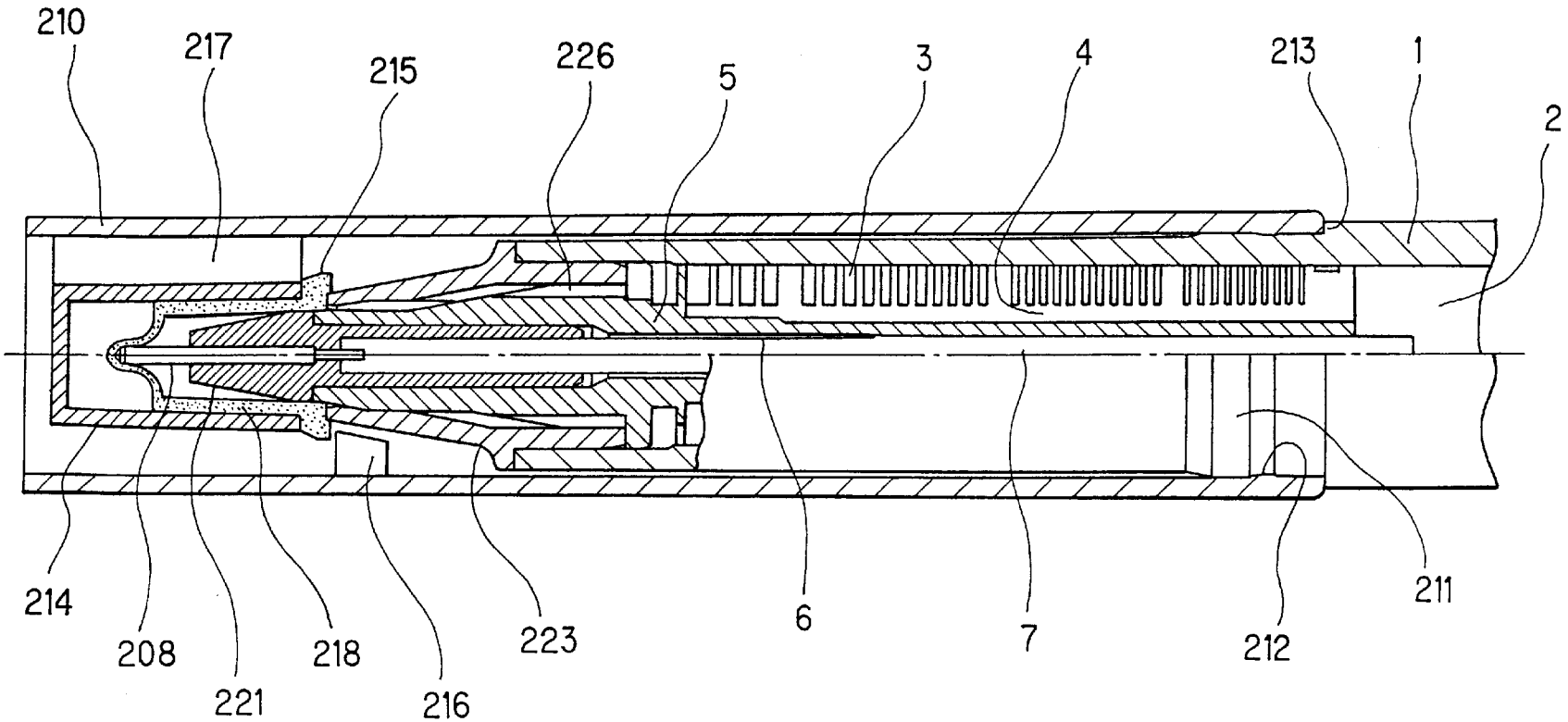
FIG. 12 is a longitudinal sectional view of a writing instrument according to the present invention.
Figure 13:
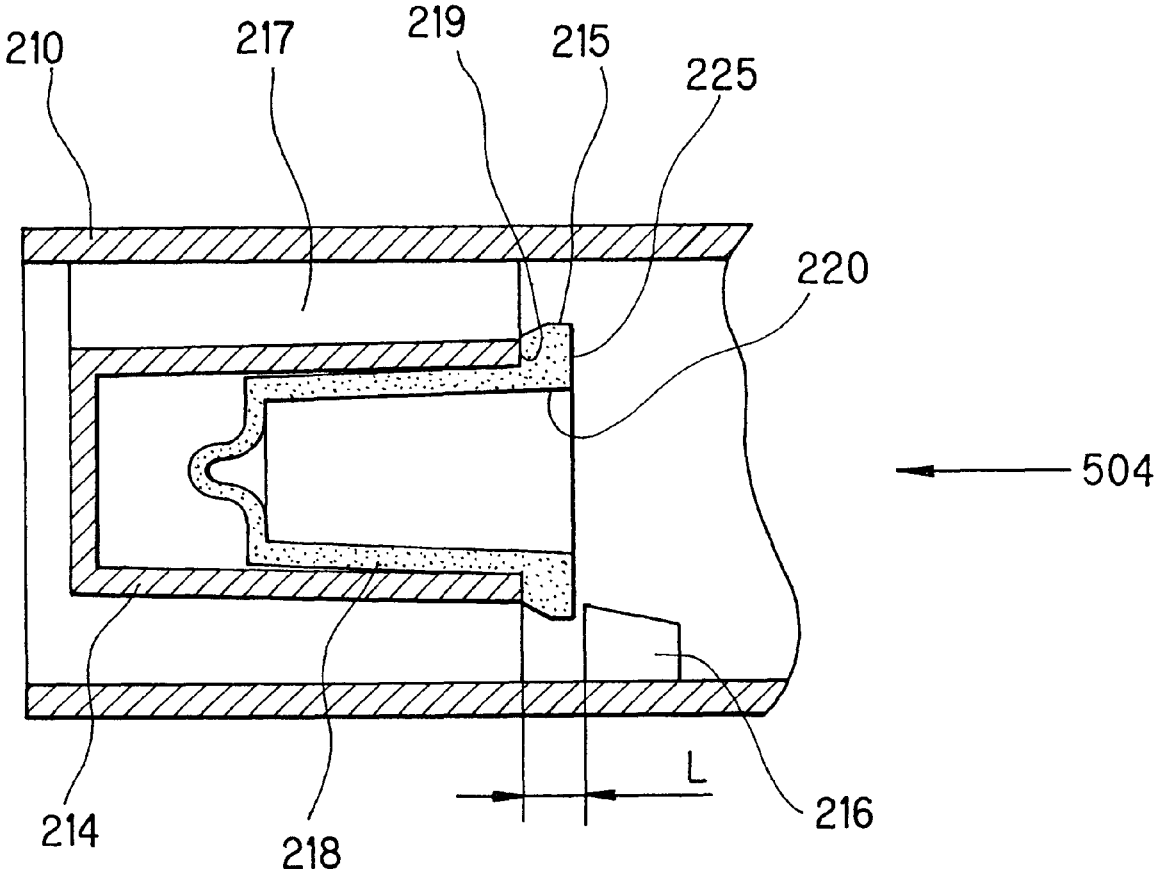
FIG. 13 is a partial sectional view of the cap taken along the line 505–506 of FIG. 14 from which a barrel cylinder shown in FIG. 12 is removed.
Figure 14:
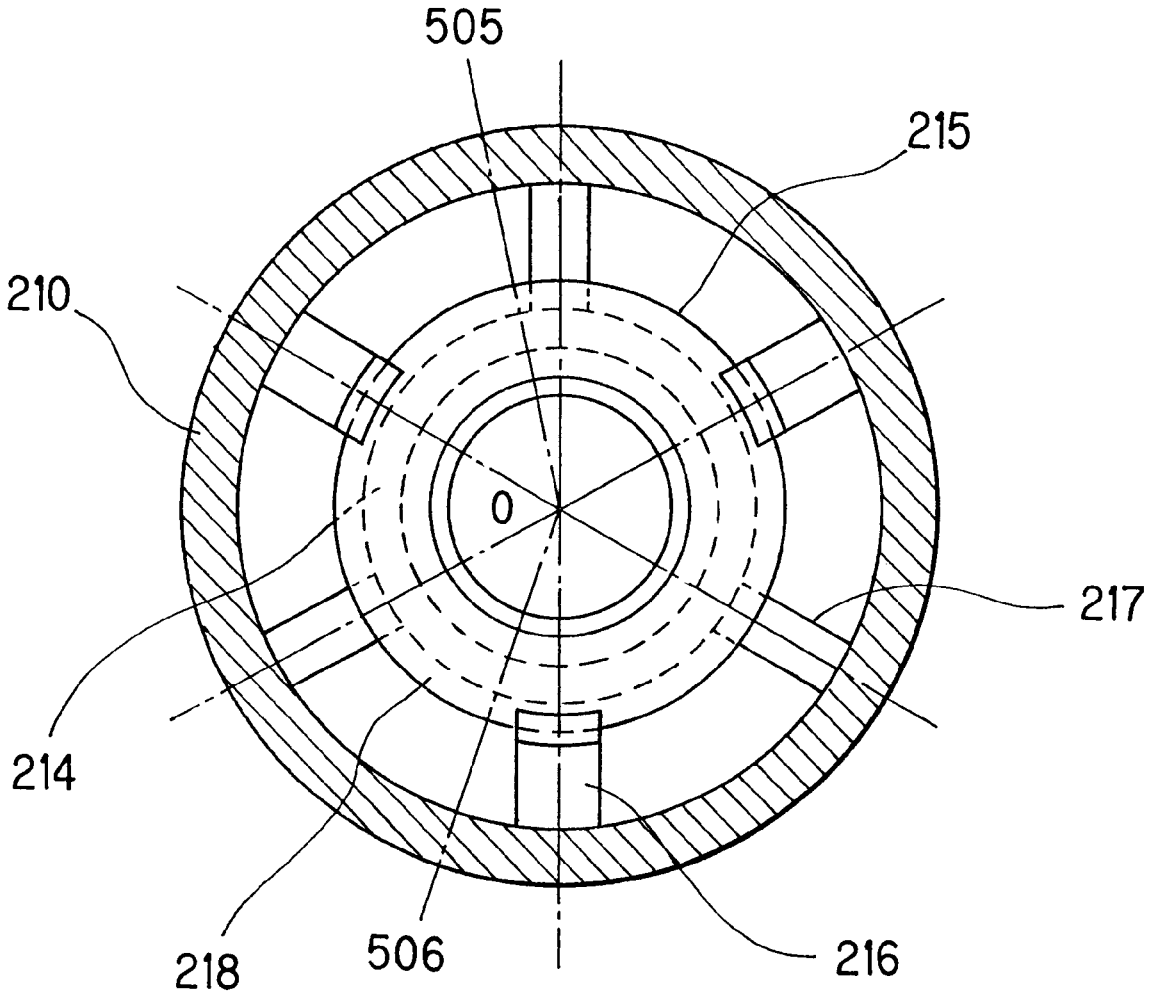
FIG. 14 is a view of the cap seen from the direction of an arrow 504 of FIG. 13.
Figure 15:
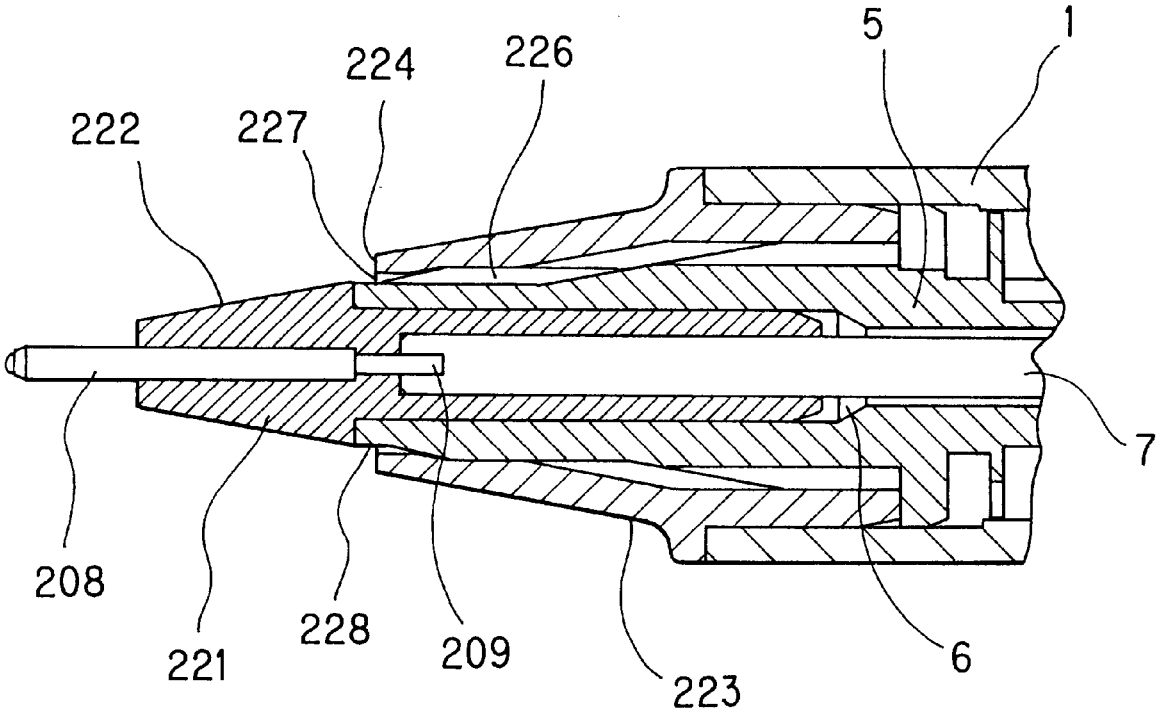
FIG. 15 is an enlarged sectional view of the front portion of the barrel cylinder.

FIG. 11 is a view for a reference showing a state wherein the end face 121 of the seal cylinder 119 starts to fit with the opening portion 124 of the air groove 112 from the intermediate portion of the air groove 112.

Third Embodiment

FIGS. 12 to 15 show the third embodiment of the present invention. The third embodiment of the present invention will be described in detail with reference to FIGS. 12 to 15. The rear portion of a barrel cylinder 1 of the writing instrument main body forms an ink chamber 2. An ink reservoir 5, having a large number of circumferential grooves 3 in its outer circumferential surface and a longitudinal groove 4 that causes the circumferential grooves 3 to communicate with each other, is mounted on the front portion of the barrel cylinder 1. A longitudinal hole 6 extending in the axial direction is formed in the central portion of the ink reservoir 5. A feed 7 is loaded to extend through the longitudinal hole 6. A point assembly 208 of the ball point pen is mounted on the distal end of the feed 7. A relay feed 209 is inserted in the point assembly 208. The ink flows from the ink chamber 2 to the feed 7 and is supplied to the ball at the distal end of the point assembly 208 through the relay feed 209.

A cap 210 is formed with an engaging projection 212, which engages with a projection 211 of the barrel cylinder 1, on its inner surface near the opening edge. The engaging projection 212 engages with the projection 211 of the barrel cylinder 1. The opening end portion of the cap 210 abuts against a step portion 213 formed in the intermediate portion of the barrel cylinder 1, so that the cap 210 is mounted on the barrel cylinder 1 at a predetermined position. An inner cylinder 214 is formed in the cap 210 to be integral with it. A plurality of engaging pieces 216 are integrally formed on the inner wall of the cap 210 at a distance (L), which is larger than the thickness of a flange portion 215 of a seal cylinder 218 by about 0.1 mm to 1 mm, from the opening end of the inner cylinder 214 toward the opening side of the cap. The plurality of engaging pieces 216 are arranged at such positions that the diameter of their inscribed circle is larger than the outer diameter of an opening end portion 219 of the inner cylinder 214 and that they will not interfere with support ribs 217 of the inner cylinder 214 when seen from the opening portion of the cap. The seal cylinder 218 made of elastic rubber or the like is inserted into the inner cylinder 214 of the cap 210 having this structure, and is passed through the engaging pieces 216 while elastically deforming the flange portion 215 having an outer diameter larger than the diameter of the inscribed circle of the plurality of engaging pieces 216 formed in the cap 210. The flange portion 215 of the seal cylinder 218 is abutted against the opening end portion 219 of the inner cylinder 214, thereby fixing the seal cylinder 218. In the pushing direction, the flange portion 215 engages with the opening end portion 219 of the inner cylinder 214. When the cap 210 is moved in the extracting direction, the flange portion 215 of the seal cylinder 218 abuts against the plurality of engaging pieces 216, so that the seal cylinder 218 will not be removed.

When the cap 210 is attached, first, the distal end portion of the point assembly 208 is brought into tight contact with the bottom of the cup-like seal cylinder 218 made of elastic rubber or the like to hermetically seal the ink outflow portion of the point assembly 208. An inner opening edge 220 of the seal cylinder 218 is fitted on a conical surface 222 of a point assembly support 221 from the intermediate portion of the conical surface 222. When attachment of the cap 210 is complete, an end face 225 of the seal cylinder 218 abuts against an end portion 224 of a mouth piece 223 to come into tight contact with it under pressure, and the inner opening edge 220 of the seal cylinder 218 comes into tight contact with a cylindrical portion 228 of the ink reservoir 5 and the conical surface 222 of the point assembly support 221, so that an opening portion 227 of an air groove 226 is closed.

In the cap 210 having the above arrangement, since the seal cylinder 218 is in tight contact with the point assembly support 221, the distal end cylindrical portion 228 of the ink reservoir 5, and further the end portion 224 of the mouth piece 223, an adhesion force acts on these members due to the self-tackiness of the seal cylinder 218. Even if the seal cylinder 218 is pressed into and fitted in the inner cylinder 214, it may undesirably come off from the inner cylinder 214. Even if the seal cylinder 218 should come off from the inner cylinder 214, its moving amount is small since the flange portion 215 abuts against the engaging pieces 216. The seal cylinder 218 will not move further. After the seal cylinder 218 separates from the distal end of the writing instrument main body, in the next cap attaching operation also, the opening portion 227 of the air groove 226 and the point assembly are hermetically sealed.

In the writing instrument having the above arrangement, when the cap 210 is mounted on the writing instrument main body, the inner opening edge 220 of the cup-like seal cylinder 218 made of elastic rubber or the like fits on the conical surface 222 of the point assembly support 221 from the intermediate portion of the conical surface 222. When attachment of the cap 210 is completed, the end face 225 of the seal cylinder 218 abuts against an end portion 224 of the mouth piece 223 to come into tight contact with it under pressure, and the inner opening edge 220 of the seal cylinder 218 comes into tight contact with the cylindrical portion 228 of the ink reservoir 5 and the conical surface 222 of the point assembly support 221, so that the opening portion 227 of the air groove 226 is closed. Since the seal cylinder 218 is in tight contact with the conical surface 222 of the point assembly support 221, the distal end cylindrical portion 228 of the ink reservoir 5, and further the end portion 224 of the mouth piece 223, an adhesion force acts on these members due to the self-tackiness of the seal cylinder 218. Even if the seal cylinder 218 is pressed and fitted in the inner cylinder 214, when the cap 210 is detached, the seal cylinder 218 may sometimes adhere to the barrel cylinder and remove from the inner cylinder 214. Even if the seal cylinder 218 should come off from the inner cylinder 214, its moving amount is small since the flange portion 215 abuts against the engaging pieces 216. The seal cylinder 218 will not further move. After the seal cylinder 218 separates from the distal end of the writing instrument main body, in the next cap attaching operation also, the opening portion 227 of the air groove 226 and the point assembly are hermetically sealed.

Fourth Embodiment

Figure 16:
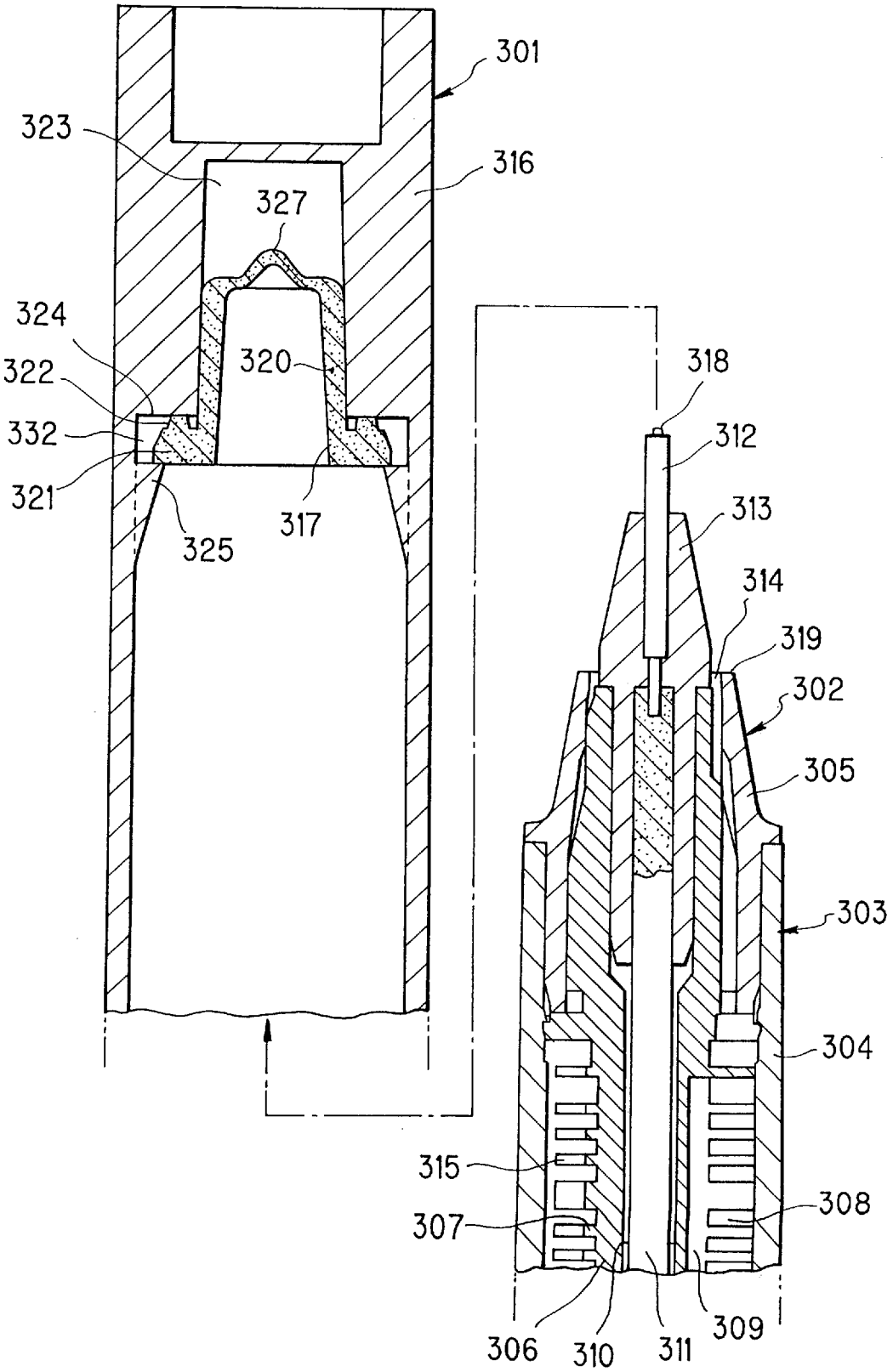
FIG. 16 is a sectional view showing a state before a cap is fitted on a writing instrument.

The fourth embodiment of the present invention will be described with reference to the accompanying drawings. FIGS. 16 to 19 concern the fourth embodiment. FIG. 16 shows a state before a cap 301 is fitted on a writing instrument 302. In the writing instrument 302, a front barrel cylinder 305 is connected to the front end of a barrel cylinder main body 304 (the upper side of FIG. 16 corresponds to the front side) to constitute a writing instrument barrel cylinder 303. An ink tank (not shown) for directly reserving an ink is formed in the rear half of the writing instrument barrel cylinder 303, and an ink reservoir 306 is disposed in front of the ink tank. The ink reservoir 306 has a large number of vanes 307 on its outer circumferential portion, and portions among the respective vanes 307 form ink reservoir grooves 308. The respective ink reservoir grooves 308 communicate with each other through an ink guide groove 309 extending in the back-and-forth direction. The rear end of the ink guide groove 309 communicates with the ink tank. If the ink in the ink tank is excessively pushed out from the ink tank due to expansion causor the likmperature rise or the like, the excessive ink flows through the ink guide groove 309 to be accommodated in the ink reservoir grooves 308. The ink reservoir 306 has a communication hole 310 extending in the back-and-forth direction in its central portion, and a feed 311 extends through the communication hole 310. The rear end portion of the feed 311 extends into the ink tank and absorbs the ink in the ink tank by capillarity, thereby guiding it forward. A point assembly 313 on which a pen feed 312 is mounted is connected to the front end of the ink reservoir 306, and the point assembly 313 is connected to the front end portion of the feed 311. The ink guided to the front end of the feed 311 is supplied to the pen feed 312 of the point assembly 313 and then to a writing point 318 of the pen feed 312. Then, the writing instrument is rendered writable. An air replacement hole 314 is formed at a position in the front end of the front barrel cylinder 305 near the writing point 318. The air replacement hole 314 extends into the writing instrument barrel cylinder 303 and communicates with the ink tank through an air channel 315 formed by partly notching the vanes 307 of the ink reservoir 306.

Figure 17:
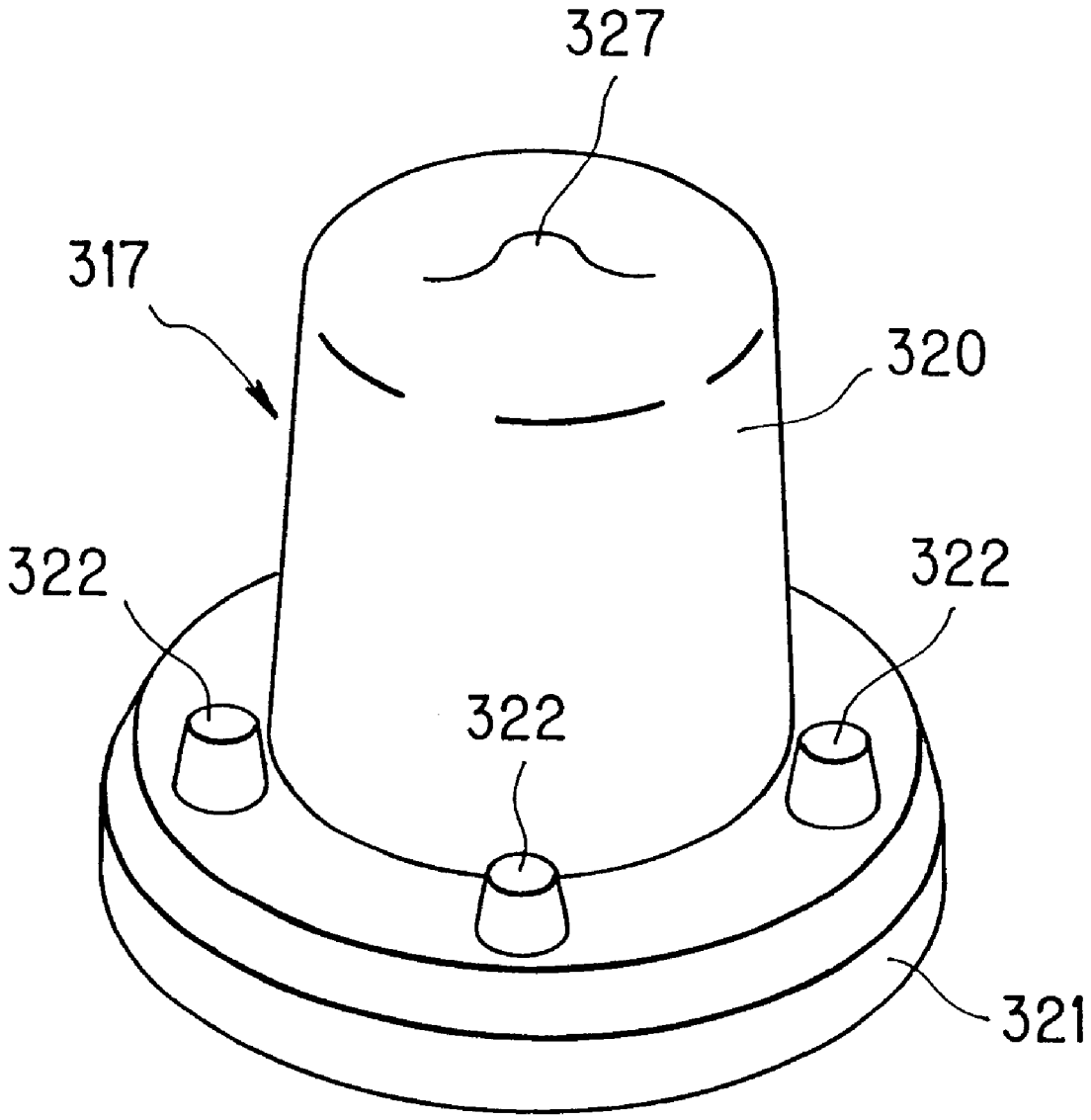
FIG. 17 is a perspective view of an inner cap.
Figure 18:
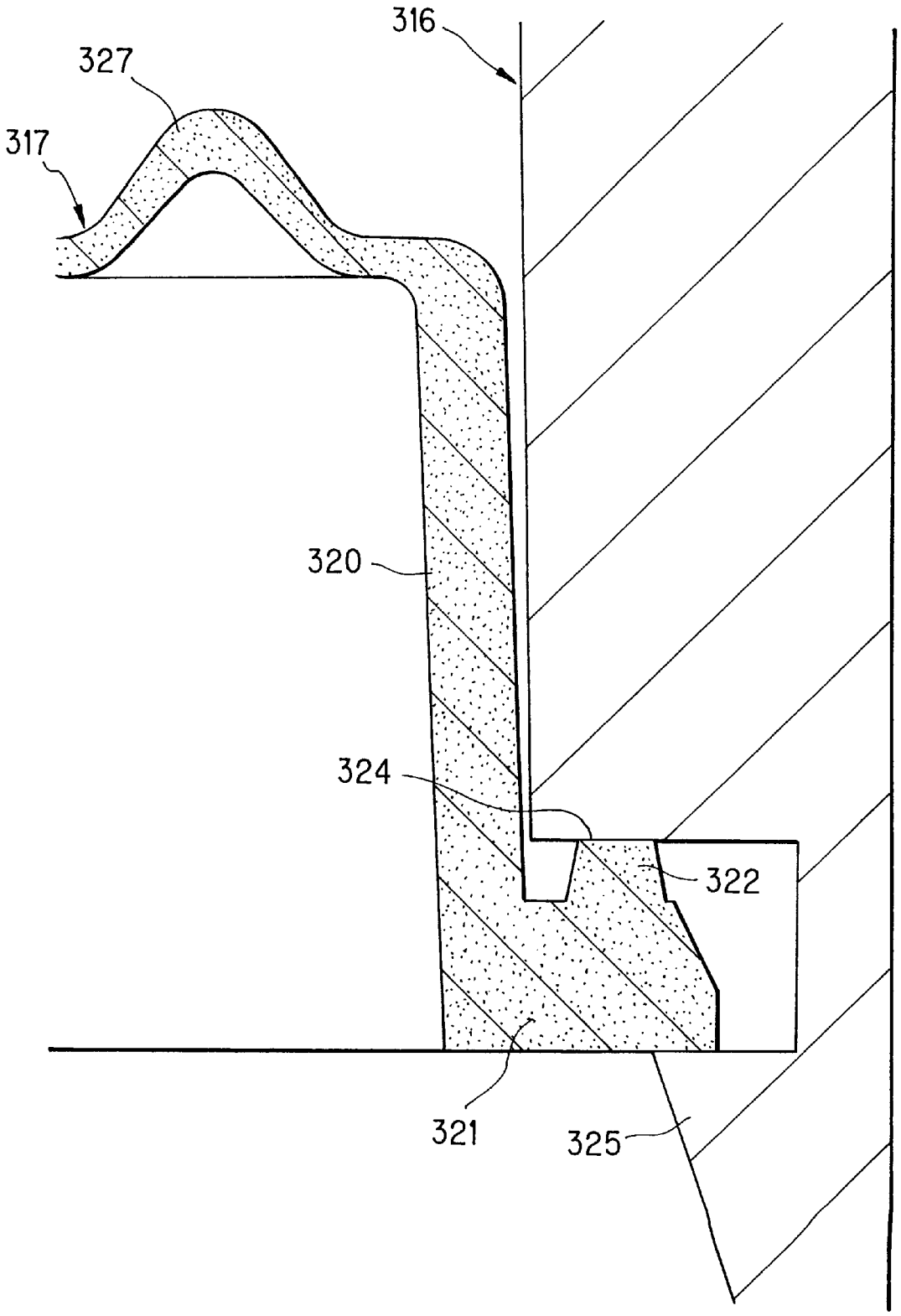
FIG. 18 is a partial enlarged sectional view showing a state before the inner cap seals the point assembly of the writing instrument.

The cap 301 is constituted by a cap main body 316 made of a hard plastic, and an inner cap 317 mounted in the cap main body 316. The inner cap 317 is made of a material, e.g., rubber or a soft plastic, which has flexibility and elasticity. As shown in FIG. 17, the inner cap 317 has a bottomed seal cylindrical portion 320 and a flange 321 extending from the outer circumferential portion of the opening end of the seal cylindrical portion 320. A plurality of trancate-conical elastic projections 322 are integrally formed on the front surface of the flange 321 at portions on the circumference. The inner cap 317 is mounted by inserting its seal cylindrical portion 320 in a hole portion 323 deep in the cap main body 316 such that the elastic projections 322 of its flange 321 abut against a step portion 324 around the hole portion 323. The flange 321 is hooked by projections 325 formed on the inner surface of the circumferential wall of the cap main body 316.

Figure 19:
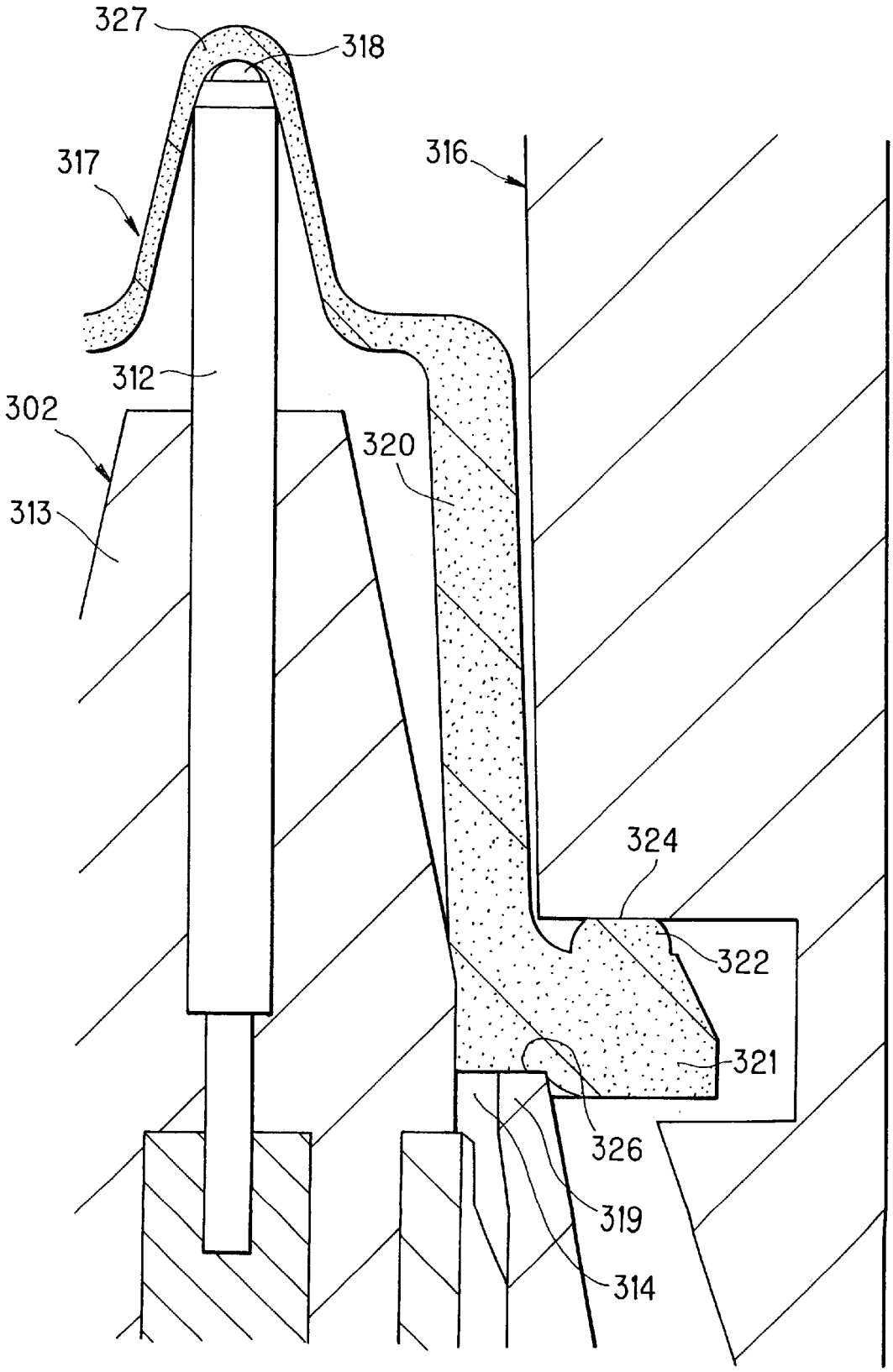
FIG. 19 is a partial enlarged sectional view showing a state after the inner cap seals the point assembly of the writing instrument.

FIG. 19 shows a state wherein the point assembly of the writing instrument 302 is inserted in the inner cap 317 to seal the writing point 318 and air replacement hole 314. When the point assembly of the writing instrument 302 is inserted in the inner cap 317, first, the distal end portion of the pen feed 312 abuts against a concaved portion 327 formed on the bottom of the seal cylindrical portion 320. Subsequently, a front end corner portion 319 of the front barrel cylinder 305 of the writing instrument barrel cylinder 303 abuts against the flange 321 of the inner cap 317 to seal the writing point 318 and air replacement hole 314. When the front end corner portion 319 of the front barrel cylinder 305 is made to abut against the flange 321, the elastic projections 322 formed on the flange 321 are compressed by the abutting pressure. Deformation of the elastic projections 322 absorbs the dimensional tolerance in axial direction of the writing instrument barrel cylinder 303 and/or cap main body 316. The portion where the front end corner portion 319 of the front barrel cylinder 305 abuts against the flange 321 of the inner cap 317 is set nearer the center in the radial direction than the portions where the elastic projections 322 of the flange 321 abut against the step portion 324 of the cap main body 316, and is located substantially on the extension line of the seal cylindrical portion 320. More specifically, an abutting portion 326 of the front end corner portion 319 of the front barrel cylinder 305 and the flange 321 of the inner cap 317 is offset from the portion where the elastic projections 322 abut against the step portion 324 of the cap main body 316. Hence, after the elastic projections 322 of the flange 321 are compressed in the manner as described above, the inner end portion of the flange 321 is pushed by the front barrel cylinder 305 to be bent, and accordingly the seal cylindrical portion 320 is further displaced in the pushing direction of the front barrel cylinder 305. An engaging projection (not shown) formed on the cap main body 316 near its opening end engages with an engaging projection (not shown) formed on the barrel cylinder main body 304 to fix the writing instrument 302 and cap 301 with each other. More specifically, when sealing the point assembly of the writing instrument 302 with the inner cap 317, compression of air in the inner cap 317 can be avoided by displacement of the seal cylindrical portion 320. Compression of the elastic projections 322 of the flange 321 mainly absorbs dimensional tolerance, as described above. Since displacement of the seal cylindrical portion 320 is caused also by compression of the elastic projections 322, compression of the elastic projections 322 synergistically enhances the effect of compression prevention of air in the inner cap 317.

Fifth Embodiment

Figure 20:
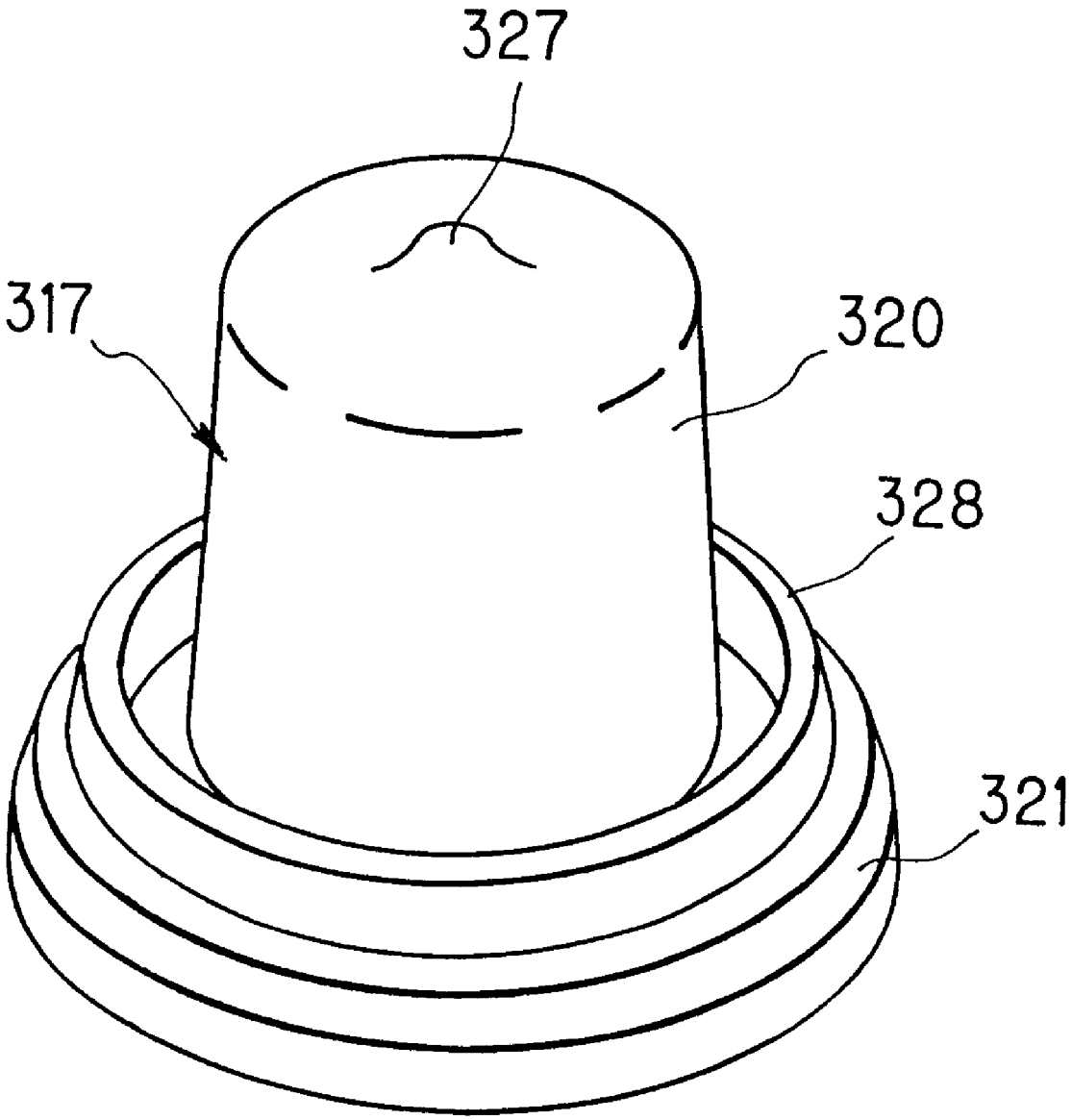
FIG. 20 is a perspective view of an inner cap.
Figure 21:
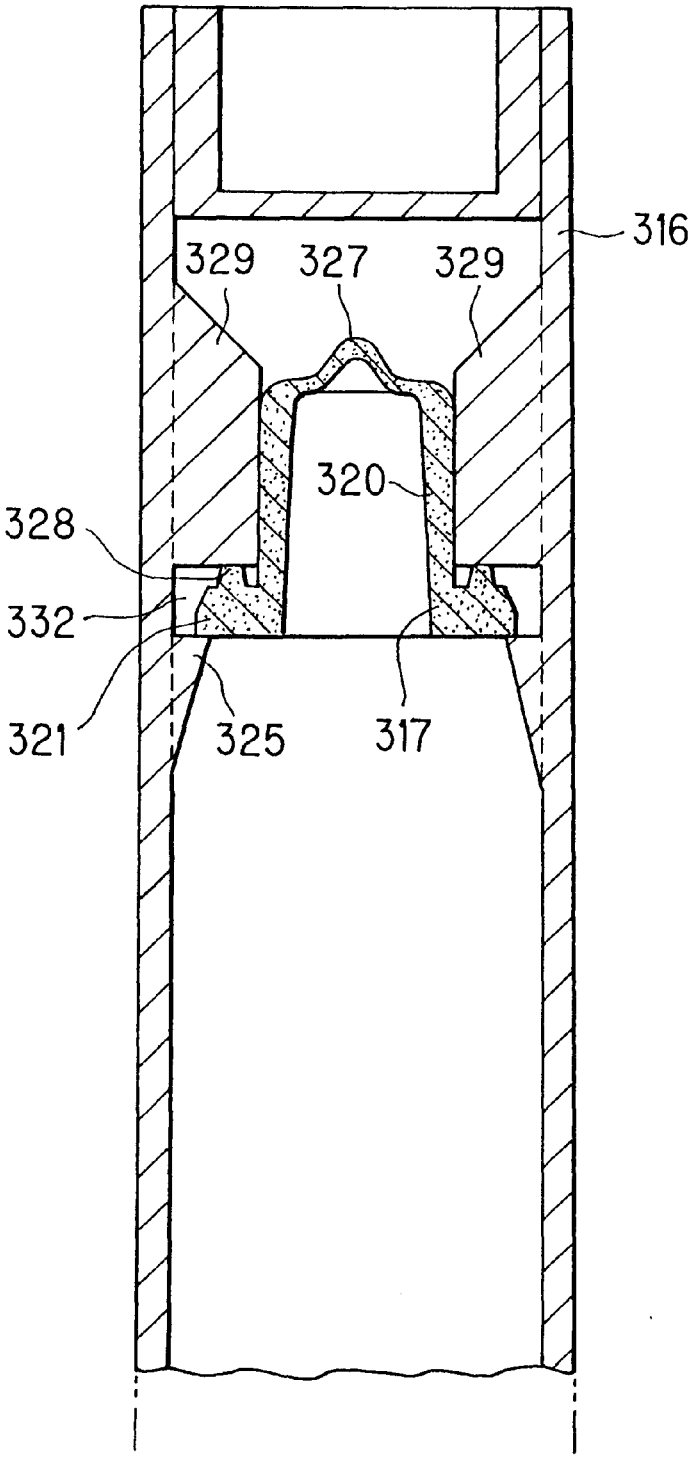
FIG. 21 is a sectional view of a cap.

FIGS. 20 and 21 concern the fifth embodiment. In the fifth embodiment, the shape of an elastic projection 328 formed on a flange 321 of an inner cap 317 is different from that of the fourth embodiment described above. More specifically, in the inner cap 317 of the fifth embodiment, the annular elastic projection 328 is formed on the flange 321, as shown in FIG. 20. If the elastic projection 328 is formed annular in this manner, ribs 329 that abut against it can be formed at appropriate positions, as shown in FIG. 21, and the cumbersome operation of aligning the ribs 329 and elastic projection 328 with each other is not required. Except for this, the structure and function of the fifth embodiment are the same as those of the fourth embodiment described above.

Sixth Embodiment

Figure 22:
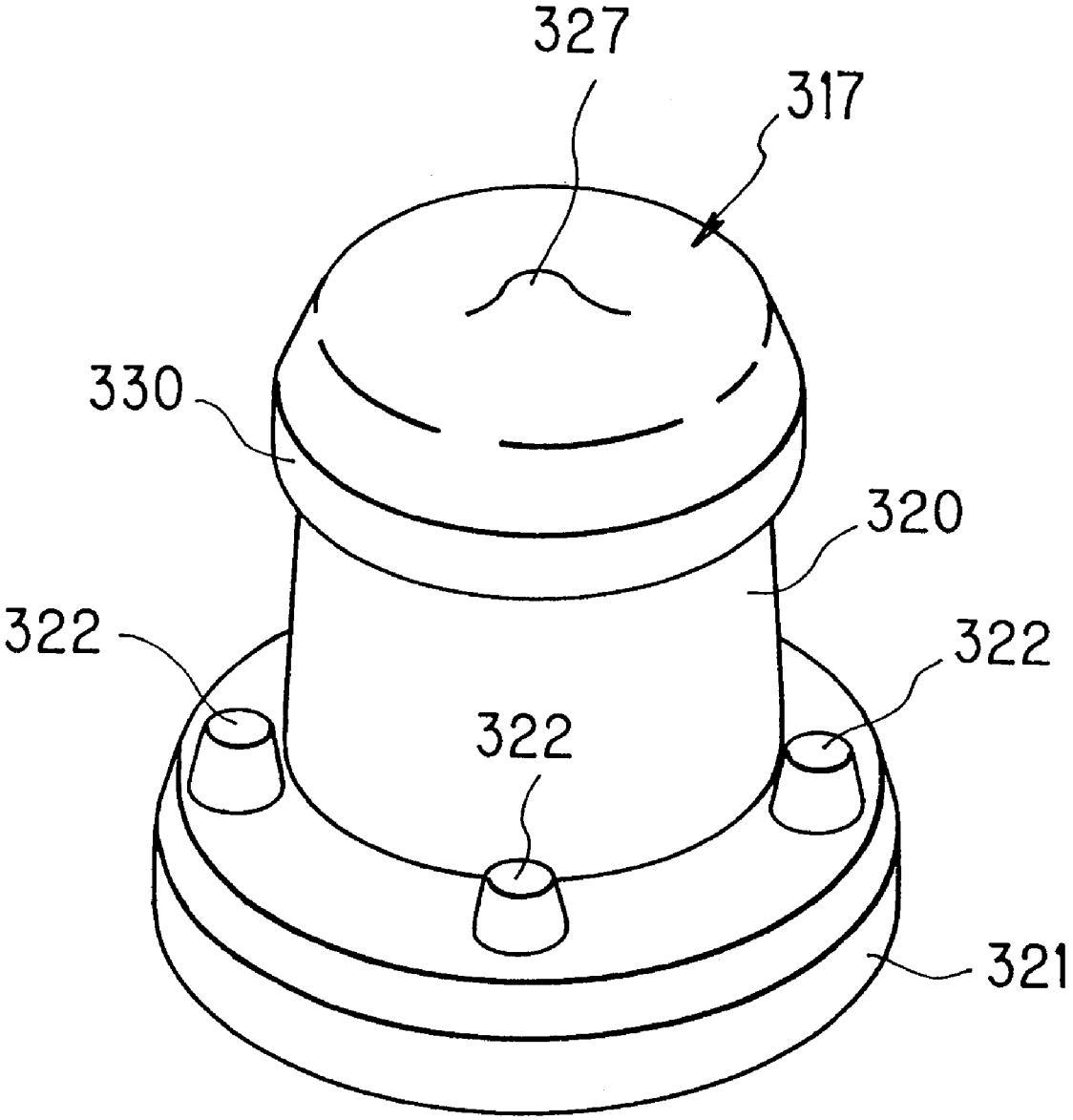
FIG. 22 is a perspective view of an inner cap.
Figure 23:
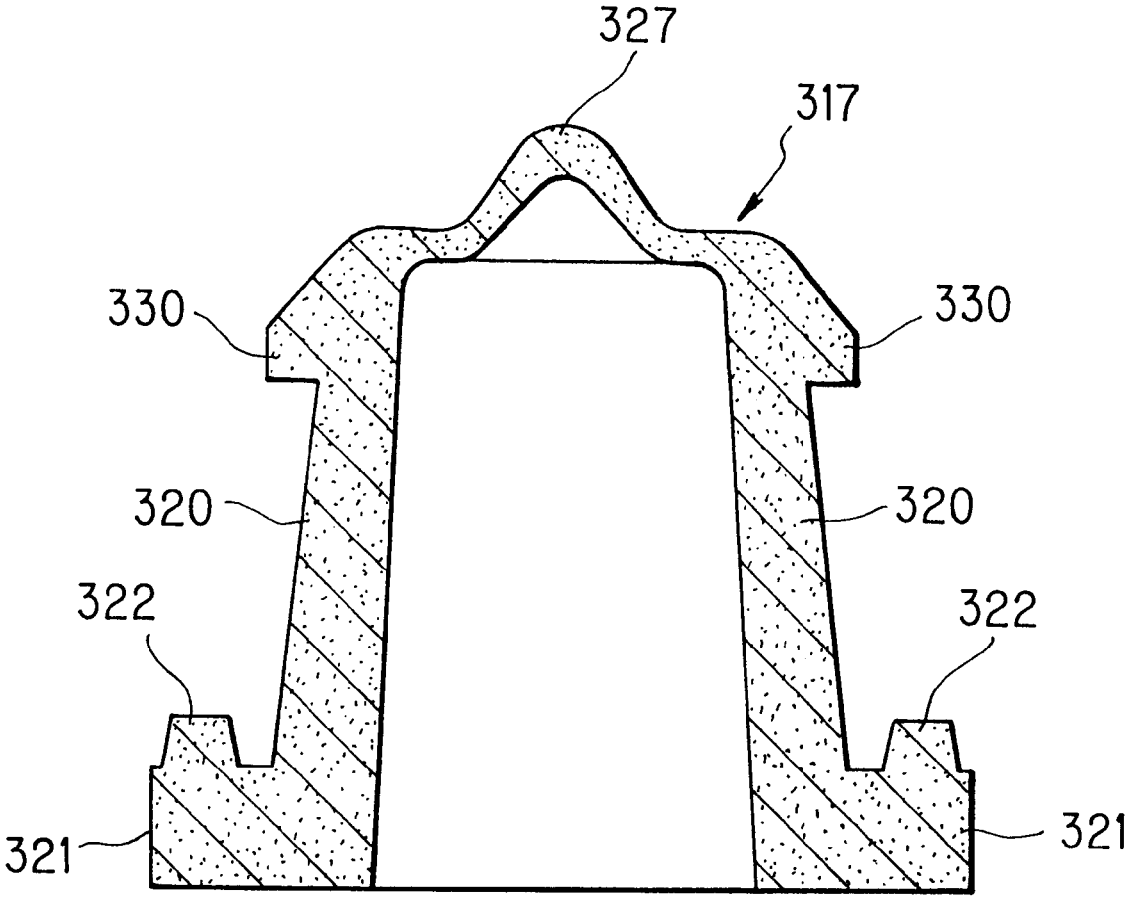
FIG. 23 is a sectional view of the inner cap.
Figure 24:
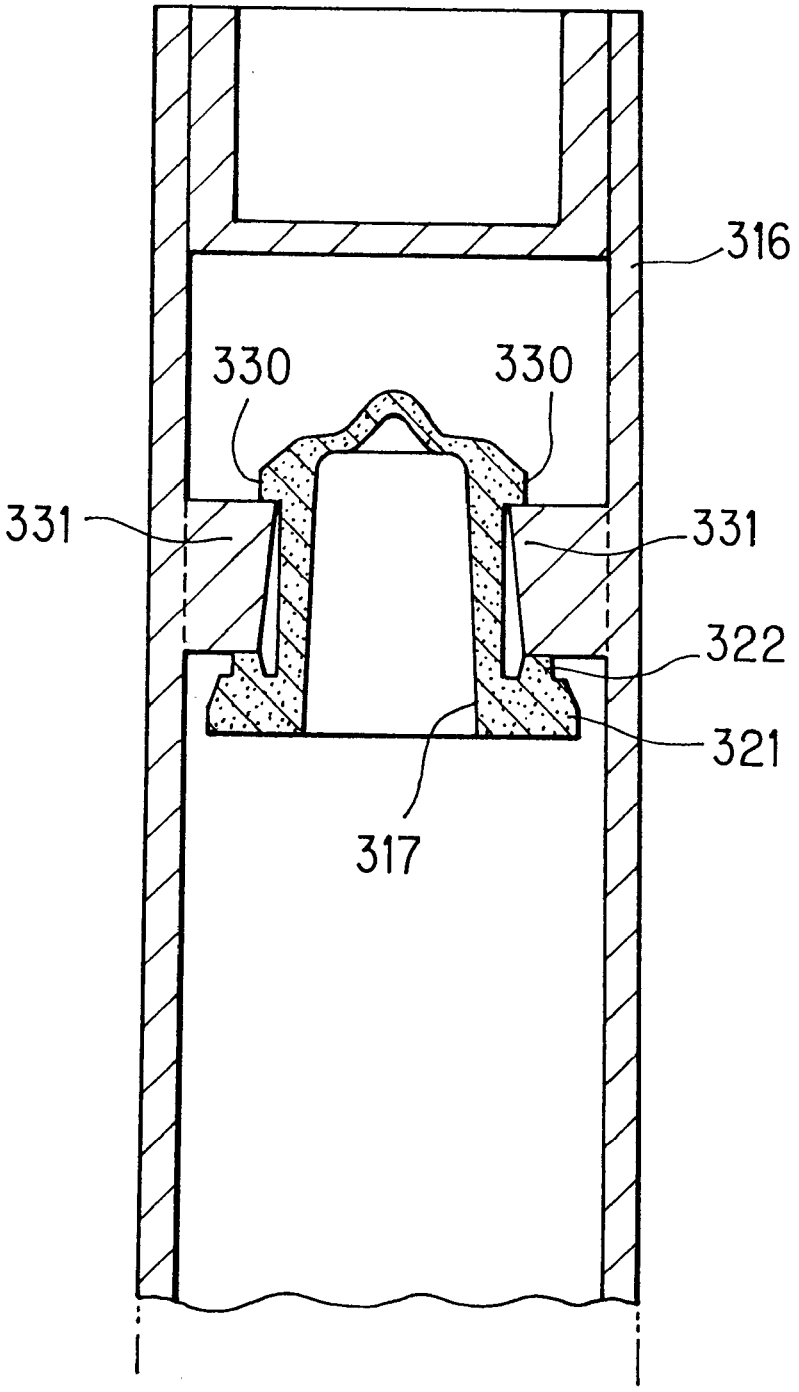
FIG. 24 is a sectional view of a cap.
Figure 25:
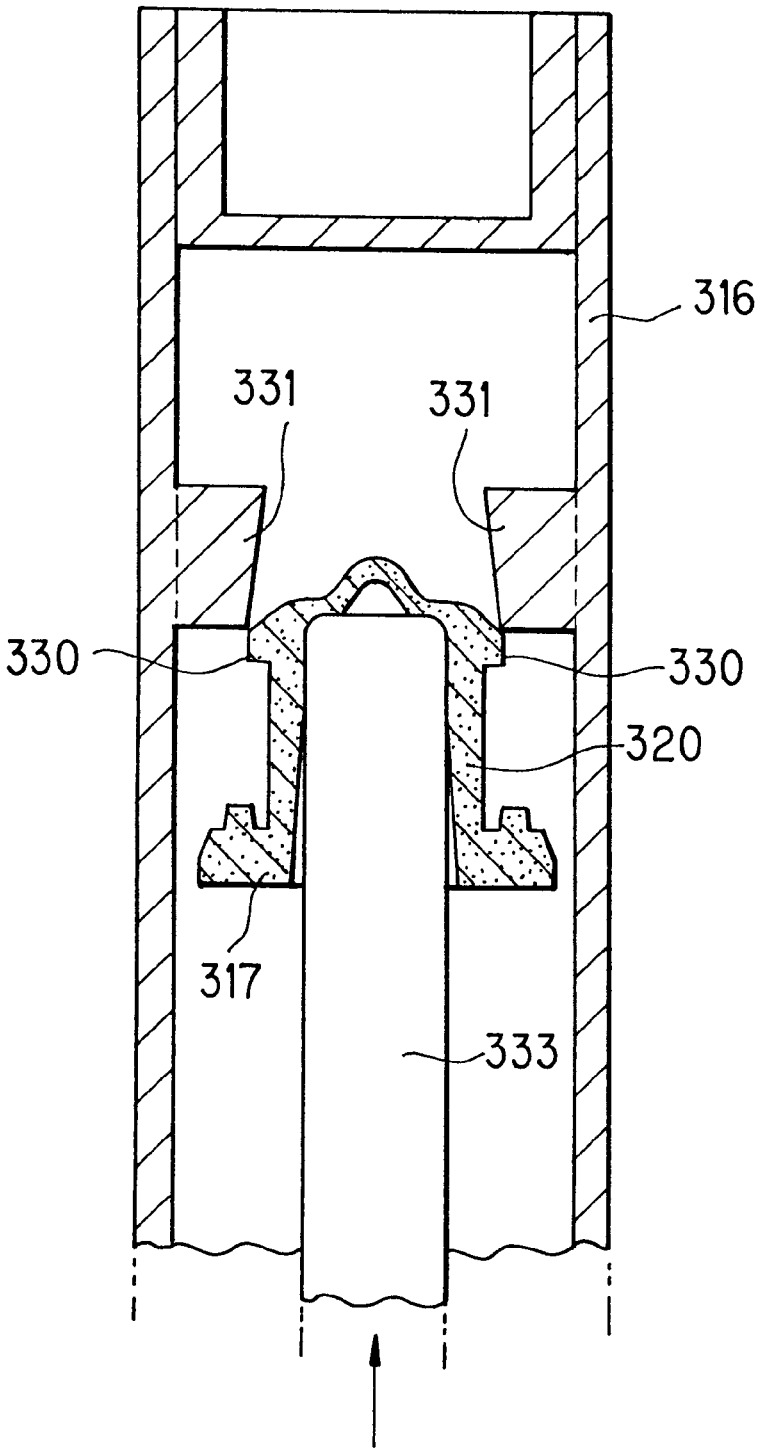
FIG. 25 is a sectional view showing a state wherein the inner cap is assembled in the cap main body.

FIGS. 22 to 25 concern the sixth embodiment. In the sixth embodiment, a hooking flange portion 330 is formed on the outer circumferential portion of the distal end of a seal cylindrical portion 320 of an inner cap 317, as shown in FIGS. 22 and 23, and this hooking flange portion 330 is hooked by a projection 331 formed on the inner surface portion of a cap main body 316, as shown in FIG. 24, thereby mounting the inner cap 317. When assembling the inner cap 317 of the fourth or fifth embodiment described above in the cap main body 316, the flange 321 is fitted in a groove 332 by deforming it to ride over the projections 325 formed on the inner surface of the cap main body 316, as described above. If the flange 321 is soft, it cannot be fitted in the groove 332 easily. If the hooking flange portion 330 is formed on the outer circumferential portion of the seal cylindrical portion 320, as in the sixth embodiment, when a jig 333 is inserted in the seal cylindrical portion 320 and is pushed in, the hooking flange portion 330 can easily ride over the projection 331 and hooked by it, as shown in FIG. 25. This facilitates the operation of assembling the inner cap 317 in the cap main body 316. Except for this, the structure and function of the sixth embodiment are the same as those of the fourth embodiment described above.

The arrangement and function of the present invention are as described above. Unlike the conventional inner cap, since the inner cap of the present invention need not be able to move while applying a pressure in the cap, the number of components decreases and assembly becomes easy. As a result, a good quality can be maintained at a low cost. Even if the seal cylinder adheres to the front portion of the barrel cylinder to come off from the inner cylinder during detachment of the cap, it removes from the front portion of the barrel cylinder by being moved only slightly and does not separate from the cap. The seal cylinder can thus be reliably mounted in the cap.

With the cap of the writing instrument of the present invention, when sealing the point assembly of the writing instrument and the air exchange hole with the inner cap, compression of air in the inner cap can be avoided. Therefore, accumulation of the ink in the ink reservoir provided to the writing instrument can be suppressed, as described above, and ink leakage from the air exchange hole can be prevented. Since the present invention can achieve these effects with only the function of the inner cap, the number of components or the number of assembly steps will not increase, thus preventing an increase in cost.

When an elastic projection is formed, the dimensional tolerance of the writing instrument barrel cylinder and cap main body can be absorbed.

When the elastic projection is formed in annular shape, alignment of the elastic projection with the cap main body becomes unnecessary.

When a hooking flange portion is formed on the outer circumferential portion of the seal cylindrical portion of the inner cap, the operation of assembling the inner cap in the cap main body is facilitated.

What is claimed is:

1. In a direct ink reservoir type water-based ball point pen having a tank in a rear portion of a barrel cylinder to directly store an ink and an ink reservoir in a front portion of said barrel cylinder, a cap for a writing instrument wherein, when attaching said cap to a barrel cylinder, a distal end portion of a point assembly of said ball point pen abuts against and comes into tight contact with a cup-like bottom mounted in said cap and made of an elastic resin or rubber to hermetically seal an ink outflow portion of said point assembly, an inner opening edge of a seal cylinder is fitted on a conical surface of a front portion of said ink reservoir or on a conical surface of a point assembly support from an intermediate portion of said conical surface, and upon completion of attachment of said cap, an end portion of a mouth piece is pushed to abut with a pressure against and comes into tight contact with an end face of said seal cylinder to hermetically seal an opening portion of an air groove and a point assembly.

* * * * *